US010110990B2

(12) United States Patent
Litovsky et al.

(10) Patent No.: US 10,110,990 B2
(45) Date of Patent: Oct. 23, 2018

(54) ACOUSTIC DEVICE WITH PASSIVE RADIATORS

(71) Applicant: Bose Corporation, Framingham, MA (US)

(72) Inventors: Roman N. Litovsky, Newton, MA (US); Michael Tiene, Franklin, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 15/463,535

(22) Filed: Mar. 20, 2017

(65) Prior Publication Data

US 2018/0270568 A1 Sep. 20, 2018

(51) Int. Cl.
*H04R 1/28* (2006.01)
*H04R 9/06* (2006.01)

(52) U.S. Cl.
CPC ..... *H04R 1/2834* (2013.01); *H04R 9/06* (2013.01); *H04R 2499/11* (2013.01)

(58) Field of Classification Search
CPC ..... H04R 1/2834; H04R 1/227; H04R 1/24; H04R 1/2873
USPC ..... 381/182, 186, 351, 345
See application file for complete search history.

(56) References Cited

U.S. PATENT DOCUMENTS 5,850,460 A * 12/1998 Tanaka ..... H04R 1/2834 381/182
8,031,896 B2 10/2011 Chick et al.
8,189,841 B2 5/2012 Litovsky et al.
2005/0018868 A1* 1/2005 Chick ..... H04R 1/2834 381/349
2005/0111673 A1* 5/2005 Rosen ..... B60R 11/0217 381/89
2006/0078136 A1 4/2006 Stiles et al.
(Continued)

FOREIGN PATENT DOCUMENTS

JP 2010178323 A 8/2010
WO 2016025938 A2 2/2016

OTHER PUBLICATIONS

International Search Report and Written Opinion dated Jun. 1, 2018 for International application No. PCT/US2018/023241.

*Primary Examiner* — Matthew Eason
*Assistant Examiner* — Julie X Dang

(57) ABSTRACT

An acoustic device includes an enclosure defining an internal cavity. A first passive radiator arrangement including a first passive radiator diaphragm is arranged along a first side of the internal cavity and a second passive radiator diaphragm arranged along a second, opposite side. The first passive radiator arrangement is mounted such that the first passive radiator diaphragm and the second passive radiator diaphragm can vibrate relative to the enclosure, and the first and second passive radiator diaphragms are coupled together such that there is substantially no relative movement therebetween. A second passive radiator arrangement includes a third passive radiator diaphragm. The second passive radiator arrangement is mounted such that the third passive radiator diaphragm can vibrate relative to the enclosure. An active electro-acoustic transducer arranged to radiate acoustic energy into the internal cavity and thereby excite vibration of the first, second, and third passive radiator diaphragms.

18 Claims, 24 Drawing Sheets

(56) References Cited

U.S. PATENT DOCUMENTS

| | | | | |
|---|---|---|---|---|
| 2009/0245561 | A1* | 10/2009 | Litovsky | H04R 1/2834 381/345 |
| 2010/0111343 | A1* | 5/2010 | Hsu | H04R 1/2834 381/335 |
| 2015/0281844 | A1* | 10/2015 | Stabile | H04R 1/2834 381/345 |
| 2016/0219362 | A1 | 7/2016 | Litovsky et al. | |

* cited by examiner

ACOUSTIC DEVICE WITH PASSIVE RADIATORS

BACKGROUND

This disclosure relates to an acoustic device with passive radiators.

Some acoustic devices include passive radiators. For example, U.S. Pat. No. 5,850,460 discloses an acoustic device with passive radiators of the same effective vibration area and the same effective vibration mass disposed in mutual opposition, and driver units of the same effective vibration area and the same effective vibration mass disposed in mutual opposition, all mounted to an enclosure. The vibration-reaction forces of the opposing passive radiators and opposing driver units on the enclosure are thereby mutually cancelled, and enclosure vibrations are thus reduced. Powerful bass output can be achieved because the diameter of the passive radiators can be increased at will and the use of two passive radiators achieves a large vibration area.

The total mass of the passive radiators needs to be sufficient such that the acoustic device can be tuned to the desired frequency. For bass devices, tuning is usually 30-70 Hz. In many cases the mass of one or more of the radiators must be increased by adding weight. Acoustic devices with passive radiators are thus typically relatively heavy, which limits their usefulness in portable products or products in which weight is a concern. Also, with mass-balanced passive acoustic radiators, both radiators are displaced by the same amount.

It was later discovered that as long as the effective areas of the passive radiators in such force balanced systems are the same, the masses of those passive radiators need not be the same. For example, U.S. Pub. No. 2015/0281844 describes an acoustic device that includes an enclosure and force balanced passive radiators that move in opposition to each other relative to the enclosure. An active transducer is suspended from a first one of the passive radiators, which eliminates the need to add mass to that radiator. The '844 publication is based, at least in part, on an understanding that the passive radiator that opposes the radiator that carries the active transducer can have a lighter mass, which allows it to move farther during normal operation. The effective radiating areas of the opposed passive radiators are substantially the same, and, since both radiators are exposed to the same pressure in the enclosure, both radiators have substantially the same forces. If the forces are equal then the device is force balanced at tuning.

The design described in the '844 publication has some limitations. First, above the fundamental resonant frequency the design is balanced, but the further below the resonant frequency the design is less balanced. Second, in the design described in the '844 publication, the passive radiators must be relatively large to accommodate the area of the active transducer. This drives up the respective masses of the passive radiators so even more area is needed to compensate for that additional mass. The result is a design that needs to be larger than desired for implementing in a small portable device.

SUMMARY

This disclosure is based, at least in part, on the realization that the effective area of a passive radiator arrangement can be decreased by coupling a pair of passive radiators together such that they move in unison, and such that as one of the passive radiators moves outward, away from an acoustic cavity, the other is drawn into the acoustic cavity.

This disclosure is also based, at least in part, on the realization that in an acoustic device that includes force balanced passive radiator arrangements, so long as the ratio of the effective stiffness to the effective mass of a first passive radiator arrangement is substantially equal to the ratio of the effective stiffness to the effective mass of a second passive radiator arrangement, the respective effective areas of the passive radiator arrangements need not be the same. In such cases, stability extends below the fundamental resonant frequency of the design.

All examples and features mentioned below can be combined in any technically possible way.

In one aspect, an acoustic device includes an enclosure that defines an internal cavity, and first passive radiator arrangement. The first passive radiator arrangement includes a first passive radiator diaphragm that is arranged along a first side of the internal cavity and a second passive radiator diaphragm that is arranged along a second side of the internal cavity opposite the first side. The first passive radiator arrangement is mounted to the enclosure such that the first passive radiator diaphragm and the second passive radiator diaphragm can vibrate relative to the enclosure, and the first and second passive radiator diaphragms are coupled together such that there is substantially no relative movement therebetween. The acoustic device also includes a second passive radiator arrangement and an active electro-acoustic transducer. The second passive radiator arrangement includes a third passive radiator diaphragm. The second passive radiator arrangement is mounted to the enclosure such that the third passive radiator diaphragm can vibrate relative to the enclosure. The active electro-acoustic transducer is arranged to radiate acoustic energy into the internal cavity and thereby excite vibration of the first, second, and third passive radiator diaphragms.

Implementations may include one of the following features, or any combination thereof.

In some implementations, the first passive radiator arrangement has an effective radiating area, and the second passive radiator arrangement has substantially the same effective radiating area as the first passive radiator arrangement.

In certain implementations, the first passive radiator arrangement has a first effective mass and the second passive radiator arrangement has a second effective mass that is different from the first effective mass.

In some examples, the acoustic transducer is mounted to the second passive radiator diaphragm such that the mass of the active electro-acoustic transducer contributes to the first effective mass.

In certain examples, the first effective mass is at least two times greater than the second effective mass.

In some cases, the first passive radiator arrangement has a first effective stiffness, the second passive radiator arrangement has a second effective stiffness, and the ratio of the first effective stiffness to the first effective mass is equal to the ratio of the second effective stiffness to the second effective mass.

In certain cases, the active electro-acoustic transducer is mounted to second passive radiator diaphragm such that the active electro-acoustic transducer moves when the second passive radiator diaphragm vibrates.

In some implementations, the first and second passive radiator diaphragms are coupled together via the active electro-acoustic transducer.

In certain implementations, the second passive radiator arrangement also includes a fourth passive radiator diaphragm, and the second passive radiator arrangement is mounted to the enclosure such that the fourth passive radiator diaphragm can vibrate relative to the enclosure.

In some examples, the third and fourth passive radiator diaphragms are configured to support a portable audio source such that vibrations of the third and fourth passive radiator diaphragms are coupled together via portable audio source.

In certain examples, the mass of the portable audio source contributes to the effective mass of the second passive radiator arrangement.

In some cases, the third and fourth passive radiator diaphragms include features for locking engagement with mating features on the portable audio source In certain cases, the third and fourth passive radiators are arranged on opposite sides of the enclosure, each being arranged such that their respective motion axes are at a non-zero and non-right angle relative to a motion axis of the first and second passive radiator diaphragms.

In some implementations, the second passive radiator arrangement has an effective radiating area ($A_{eff2}$), which satisfies to the following equation:

$$A_{eff2}=(A3+A4)\cos(\theta),$$

where,

A3 is the radiating area of the third passive radiator diaphragm; and

A4 is the radiating area of the fourth passive radiator diaphragm.

In certain implementations, the acoustic device further includes a housing which defines the enclosure, and the housing is configured to support a portable audio source.

In some examples, the portable audio source includes a mobile phone.

In certain examples, the first passive radiator arrangement has an effective radiating area ($A_{eff1}$), which satisfies the following equation:

$$A_{eff1}=ABS|A1-A2|$$

where,

A1 is the radiating area of the first passive radiator diaphragm; and

A2 is the radiating area of the second passive radiator including the radiating area of the active electro-acoustic transducer.

In another aspect, an acoustic device includes an enclosure, and a first passive radiator arrangement. The first passive radiator arrangement includes a first passive radiator diaphragm. The first passive radiator arrangement is mounted to the enclosure such that the first passive radiator diaphragm can vibrate relative to the enclosure, and the first passive radiator arrangement has a first effective radiating area. The acoustic device also includes a second passive radiator arrangement that includes a second passive radiator diaphragm. The second passive radiator arrangement is mounted to the enclosure such that the second passive radiator diaphragm can vibrate relative to the enclosure, and the second passive radiator arrangement is has substantially the same effective radiating area as the first passive radiator arrangement. An active electro-acoustic transducer is mounted to the second passive radiator diaphragm such that the active electro-acoustic transducer moves when the second passive radiator diaphragm vibrates. The active electro-acoustic transducer is arranged to radiate acoustic energy into the internal cavity and thereby excite vibration of the first and second passive radiator diaphragms. The first passive radiator arrangement has a first effective stiffness and a first effective mass, the second passive radiator arrangement has a second effective stiffness and a second effective mass, and the ratio of the first effective stiffness to the first effective mass is equal to the ratio of the second effective stiffness to the second effective mass. The acoustic transducer is mounted to the second passive radiator diaphragm such that the mass of the active electro-acoustic transducer contributes the first effective mass.

Implementations may include one of the above and/or below features, or any combination thereof.

In some implementations, the first effective mass is at least two times greater than the second effective mass.

In certain implementations, the first passive radiator arrangement includes a third passive radiator diaphragm that is mounted to the enclosure such that the third passive radiator diaphragm can vibrate relative to the enclosure, and the first and third passive radiator diaphragms are coupled together such that there is substantially no relative movement therebetween.

In some examples, the first passive radiator diaphragm vibrates along a first vibration axis, the second passive radiator diaphragm vibrates along a second vibration axis, and the first and second vibration axes are substantially parallel or substantially collinear.

In certain examples, the first passive radiator diaphragm and the second passive radiator diaphragm vibrate in opposition.

In some cases, the second effective mass is greater than the first effective mass; pressure changes inside the acoustic enclosure cause both passive radiator diaphragms to move in and out in opposition relative to the enclosure; the first passive radiator diaphragm moves in and out a greater distance than does the second passive radiator diaphragm; and as the first and second passive radiator diaphragms move in and out, their effective radiating areas remain substantially equal.

BRIEF DESCRIPTION OF THE DRAWINGS

Like reference numbers represent like elements.

DETAILED DESCRIPTION

Figure 1A:
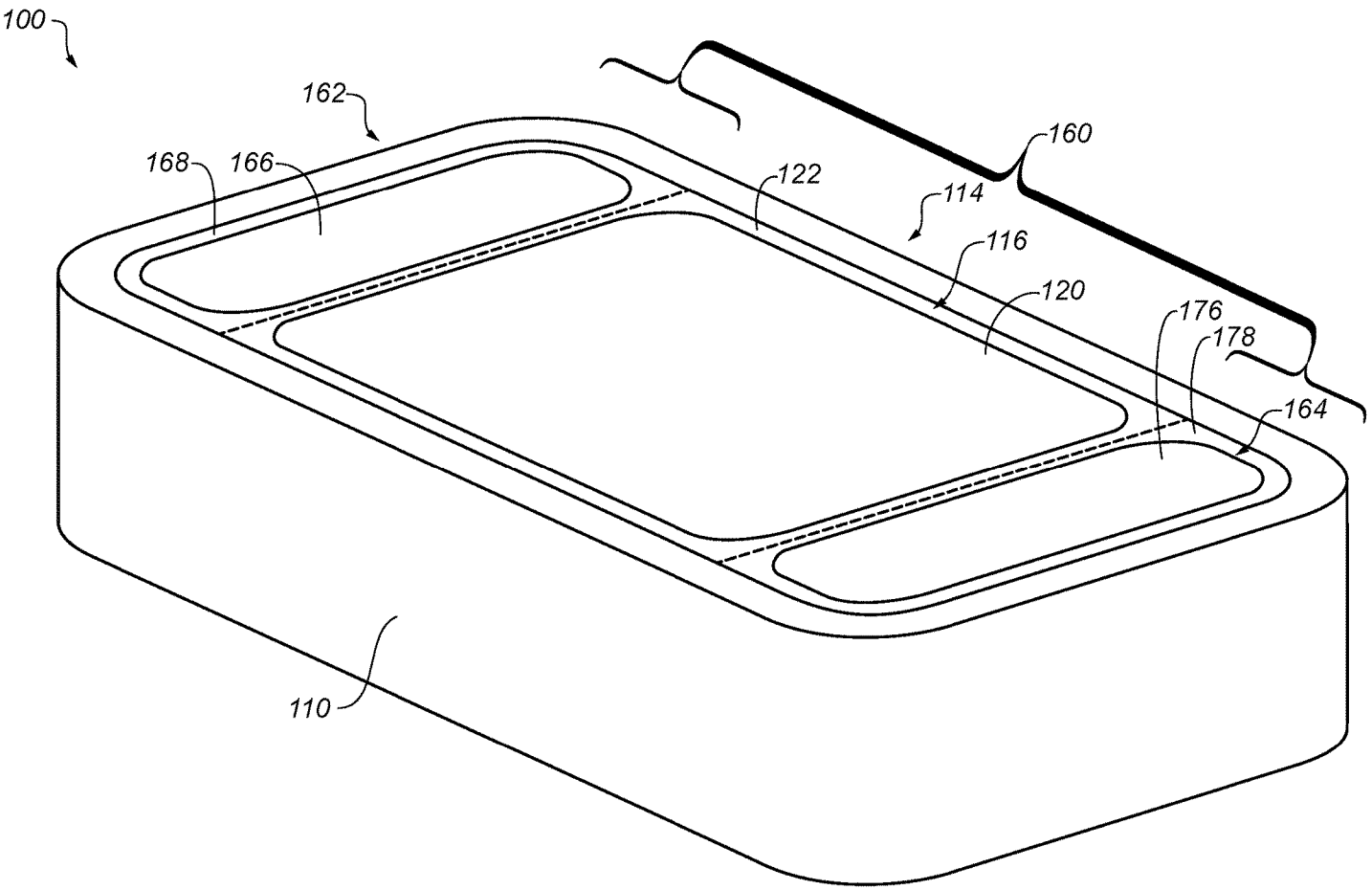
FIGS. 1A-1C re top perspective, bottom perspective, and cross-sectional side views, respectively, of an acoustic device with passive radiators.
Figure 1B:
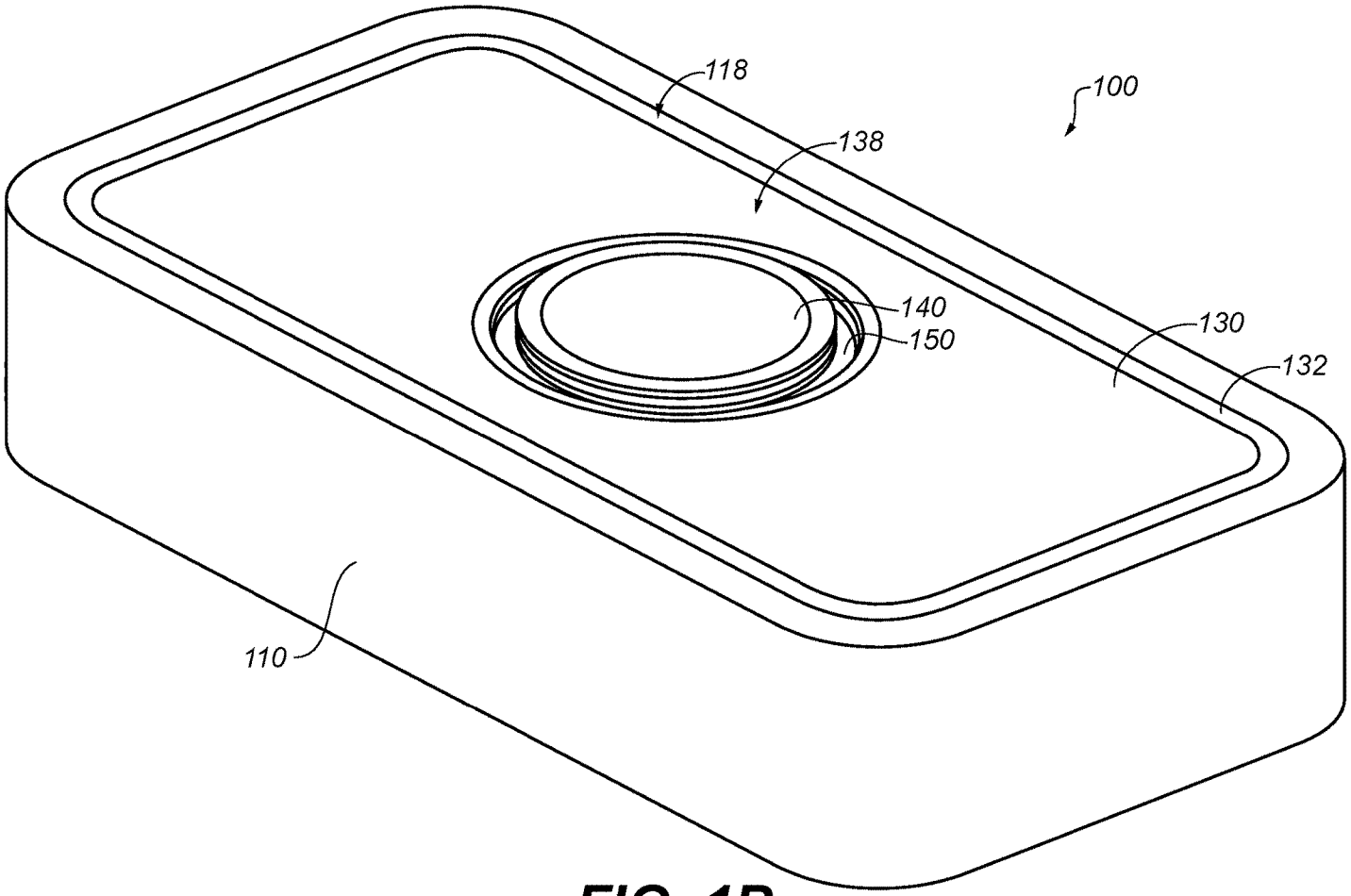
Figure 1C:
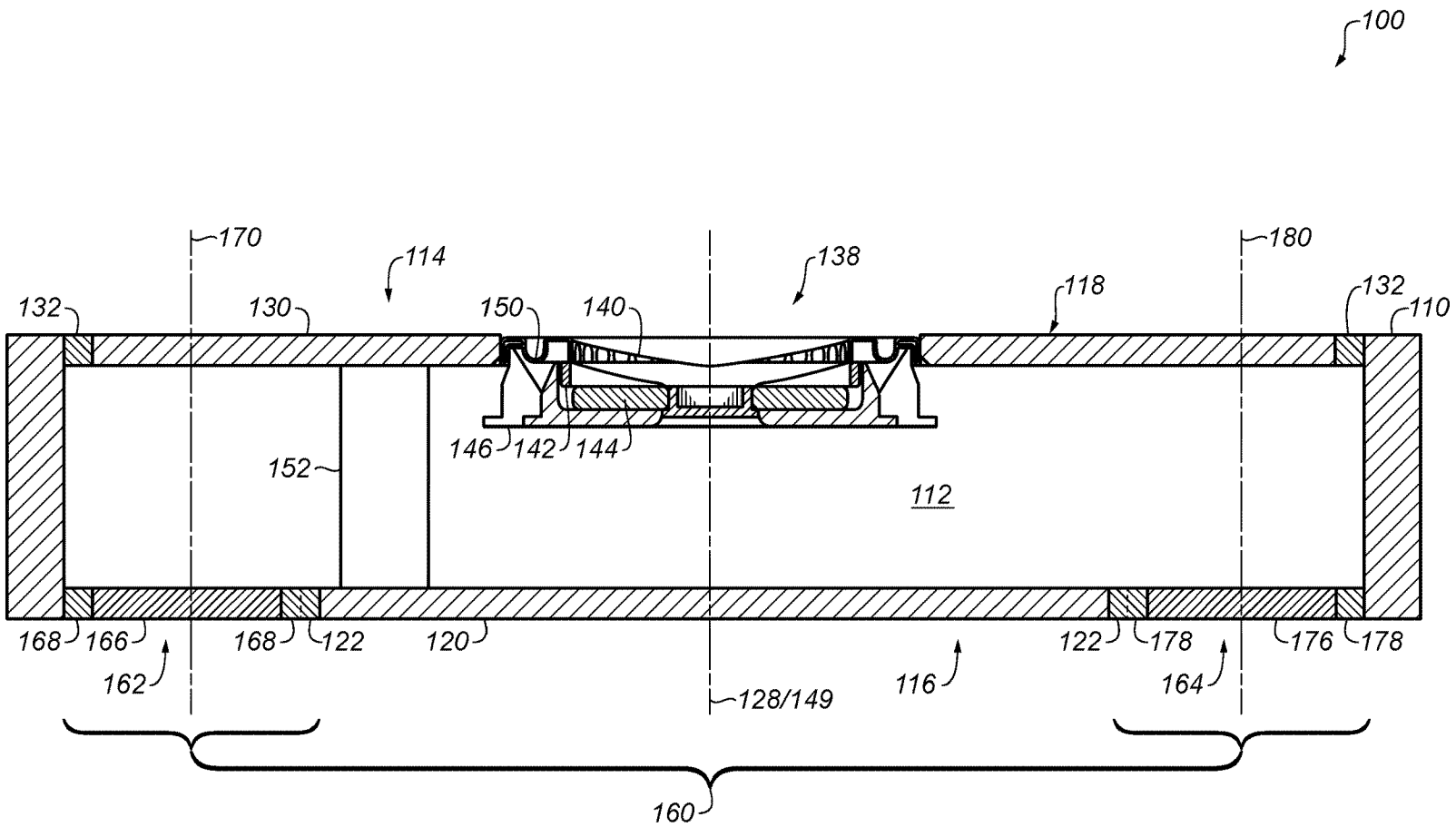

Referring to FIGS. 1A-1C, an acoustic device 100 includes an enclosure 110 which defines an interior cavity 112 (a/k/a "acoustic cavity"; FIG. 1C). A first passive radiator arrangement 114 (FIG. 1C) is supported by the enclosure 110. The first passive radiator arrangement 114 includes a pair of passive radiators (i.e., first and second passive radiators 116, 118) arranged along opposite sides of the enclosure 110 (i.e., on opposite sides of the internal cavity). The first passive radiator 116 includes a first passive radiator diaphragm 120 which is coupled to the enclosure 110 by a first suspension element 122 (a/k/a "surround"). The first passive radiator diaphragm 120 has a rear surface which is exposed to the cavity 112, and a front surface which is open to the outside of the enclosure such that it is able to radiate sound from the enclosure 110. The first passive radiator diaphragm 120 is constructed and arranged to vibrate relative to the enclosure 110 along vibration axis 128 in and out of the interior cavity 112. The first passive radiator diaphragm 120 may be an essentially flat plate as shown in the drawing or may have a different construction or form as is known in the art of passive radiator diaphragms.

The second passive radiator 118 includes a second passive radiator diaphragm 130 which is coupled to the enclosure 110 by a second suspension element 132, which allows the second passive radiator diaphragm 130 to move or vibrate in and out relative to the enclosure 110. The second passive radiator diaphragm 130 includes a rear surface which is exposed to the interior cavity 112, and a front surface which is exposed to the outside of the enclosure 110 such that it is able to radiate sound from the enclosure 110. As with the first passive radiator diaphragm 120, the second passive radiator diaphragm 130 may be an essentially flat plate as shown in the drawing or may have a different construction or form as is known in the art of passive radiator diaphragms.

An active electro-acoustic transducer 138 is mounted to the second passive radiator diaphragm 130 such that transducer 138 moves when the second passive radiator diaphragm 130 vibrates. The transducer 138 can be any known type of active acoustic transducer. In this non-limiting example transducer 138 includes a transducer diaphragm 140, a bobbin with voice coil 142, a magnet/iron 144, a basket 146, and a surround 150. The transducer diaphragm 140 is mounted to the second passive radiator diaphragm 130 such that the transducer diaphragm 140 is displaceable relative to the second passive radiator diaphragm 130 along axis 149, which, in the illustrated implementation, is coaxial with axis 128. The surround 150 does not move at the tuning frequency of enclosure 110. Therefore, the active transducer 138 is part of the second passive radiator 118, and can be operated via audio signals (not shown) so as to radiate sound.

Notably, the first and second passive radiators 116, 118 are rigidly coupled together via a coupling member 152 such that the first and second passive radiators 116, 118 move together relative to the enclosure 110 along a common motion axis 128, and such that as the first passive radiator diaphragm 120 is displaced outward away from the cavity 112 the second passive radiator diaphragm 130 is drawn into the cavity 112, and vice versa. This coupling reduces the effective radiating area ($A_{eff1}$) of the first passive radiator arrangement 114 according to equation 1.

$$A_{eff1}=ABS|A1-A_2| \quad \text{(eq. 1)}$$

where, $A_1$ is the radiating area of the first passive radiator diaphragm; and $A_2$ is the radiating area of the second passive radiator including the radiating area of the active electro-acoustic transducer 138.

This has the effect of reducing the effective area ($A_{eff2}$) needed for a second passive radiator arrangement 160 that is arranged and configured to move in opposition to the first passive radiator arrangement 114 and such that the inertial forces applied on the enclosure 110 due to the motion of the first and second passive radiator arrangements 114, 160 are substantially balanced. This ability to adjust the effective area of the first passive radiator arrangement 114 via the coupling of the first and second passive radiator diaphragms 120, 130 can allow for greater design flexibility. This can be particularly beneficial for designs in which a large passive radiator area is required in order to support an active transducer, but where a small size and light weight are desired, such as in mobile/portable applications.

In the illustrated example, the second passive radiator arrangement 160 includes a pair of passive radiators (i.e., third and fourth passive radiators 162, 164). The third passive radiator 162 includes a third passive radiator diaphragm 166 which is coupled to the enclosure 110 by a third suspension element 168, which allows the third passive radiator diaphragm 166 to move or vibrate in and out relative to the enclosure 110 along vibration axis 170 to help oppose forces exerted on the enclosure 110 attributable to motion of the first passive radiator arrangement 114. The third passive radiator diaphragm 166 includes a rear surface which is exposed to the interior cavity 112, and a front surface which is exposed to the outside of the enclosure 110 such that it is able to radiate sound from the enclosure 110.

Similarly, the fourth passive radiator 164 includes a fourth passive radiator diaphragm 176 which is coupled to the enclosure 110 by a fourth suspension element 178 which allows the fourth passive radiator diaphragm 176 to move or vibrate in and out relative to the enclosure 110 along vibration axis 180 to assist the third passive radiator 162 in opposing the forces exerted on the enclosure 110 due to motion of the first passive radiator arrangement 114. The fourth passive radiator diaphragm 176 includes a rear surface which is exposed to the interior cavity 112, and a front surface which is exposed to the outside of the enclosure 110 such that it is able to radiate sound from the enclosure 110. In the illustrated example, the second, third and fourth suspension elements 132, 168, and 178 are integrally formed. Axes 170, 180 are substantially parallel, and both are substantially parallel to axis 128.

As in the case of the first and second passive radiator diaphragms 120, 130, the third and fourth passive radiator diaphragms 166, 176, may each be implemented as an essentially flat plate as shown in the drawing or may have a different construction or form as is known in the art of passive radiator diaphragms.

The transducer 138 is mounted such that its center of mass is collinear with the center of mass of the second passive radiator arrangement 160. As the transducer 138 is operated it creates pressure changes in the cavity 112 which cause the passive radiators 116, 118, 162, 164 to move in and out and thus radiate sound from the acoustic device 100. In this arrangement the effective mass ($m_{eff1}$) of the first passive radiator arrangement 114 that is required in order to tune the enclosure 110 may be accomplished fully or at least in part with the active transducer 138. The present arrangement results in a less massive acoustic device than would be the case if the active transducer was mounted elsewhere on the enclosure. The weight savings can be a significant advantage in situations such as portable devices or even motor vehicles where a goal is to reduce weight without sacrificing functionality. Also, the acoustic device can be smaller since there is less volume needed for the active transducer. Since the acoustic device is smaller and lighter than many existing designs, it has wider applicability to more a more diverse set of products. Non-limiting examples of products that could use acoustic device 100 include personal hand-held audio devices, portable audio devices, motor vehicles, and products that are designed to hang on a wall (such as televisions and monitors).

The second passive radiator arrangement 160 has an effective radiating area ($A_{eff2}$) that is substantially the same as that of the first passive radiator arrangement 114. The effective radiating area of a radiator structure as it vibrates can be determined by mounting the structure to a known closed volume, moving the structure in and out, and detecting pressure changes in the closed volume. The effective area can then be determined relative to the stroke. The passive radiator arrangements will have substantially the same effective radiating areas when the net force imbalance due to an area mismatch between the radiators when at their maximum extensions is less than the design acceptable force imbalance for the particular acoustic device. For the implementation illustrated in FIGS. 1A-1C, the effective radiating area ($A_{eff2}$) is determined according to equation 2, below.

$$A_{eff2}=A_3+A_4 \quad \text{(eq. 2)}$$

where, $A_3$ is the radiating area of the third passive radiator diaphragm; and $A_4$ is the radiating area of the fourth passive radiator diaphragm.

The effective masses of the first and second passive radiator arrangements 114, 160 need not be the same, and, in cases where the effective masses are not the same, the lighter passive radiator arrangement moves more than the heavier radiator, and thus contributes more to the acoustic output. Without limiting the generality of the foregoing, the mass ratio of the two passive radiator arrangements of the subject acoustic devices may be in the range of from about two to about six to one. Since the first and second radiator structures are exposed to the same pressure variations as the transducer 138 is operated, substantially the same forces are developed on the two passive radiator arrangements 114, 160. The heavier structure 114 and its passive radiator diaphragms 120, 130 will thus move less than the lighter structure 160.

Notwithstanding, the forces applied to the acoustic device 100 will be balanced over all frequencies as long as $A_{eff2}=A_{eff1}$ and the following equation 3 is satisfied.

$$k_{eff1}/m_{eff1}=k_{eff2}/m_{eff2} \quad \text{(eq. 3)}$$

where, $k_{eff1}$ is the effective stiffness of the suspension elements acting on the first passive radiator arrangement 114;

$k_{eff2}$ is the effective stiffness of the suspension elements acting on the second passive radiator arrangement 160;

$m_{eff1}$ is the effective mass of the first passive radiator arrangement 114; and $m_{eff2}$ is the effective mass of the second passive radiator arrangement 160.

In the example illustrated in FIGS. 1A-1C, the effective mass ($m_{eff1}$) of the first passive radiator arrangement 114 consists essentially of the combined masses of the active transducer 138, the first passive radiator diaphragm 120, and the second passive radiator diaphragm 130; and the effective mass of the second passive radiator arrangement 160 consists essentially of the combined masses of the third and fourth passive radiator diaphragms 166, 176.

Figure 2:
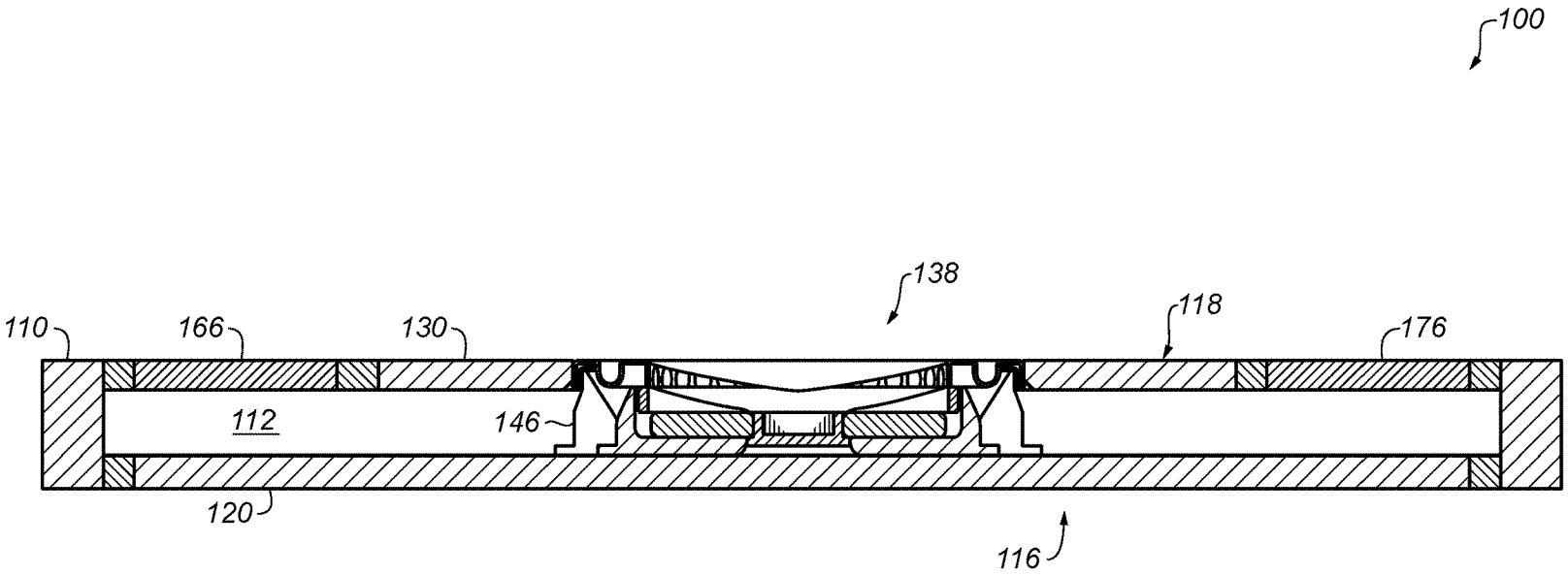
FIG. 2 is a cross-sectional side view of a second implementation of an acoustic device with passive radiators.

In some cases, the basket 146 of the transducer 138 may be used for rigidly coupling the first and second passive radiators 116, 118 to each other, such as shown in FIG. 2.

Figure 3:
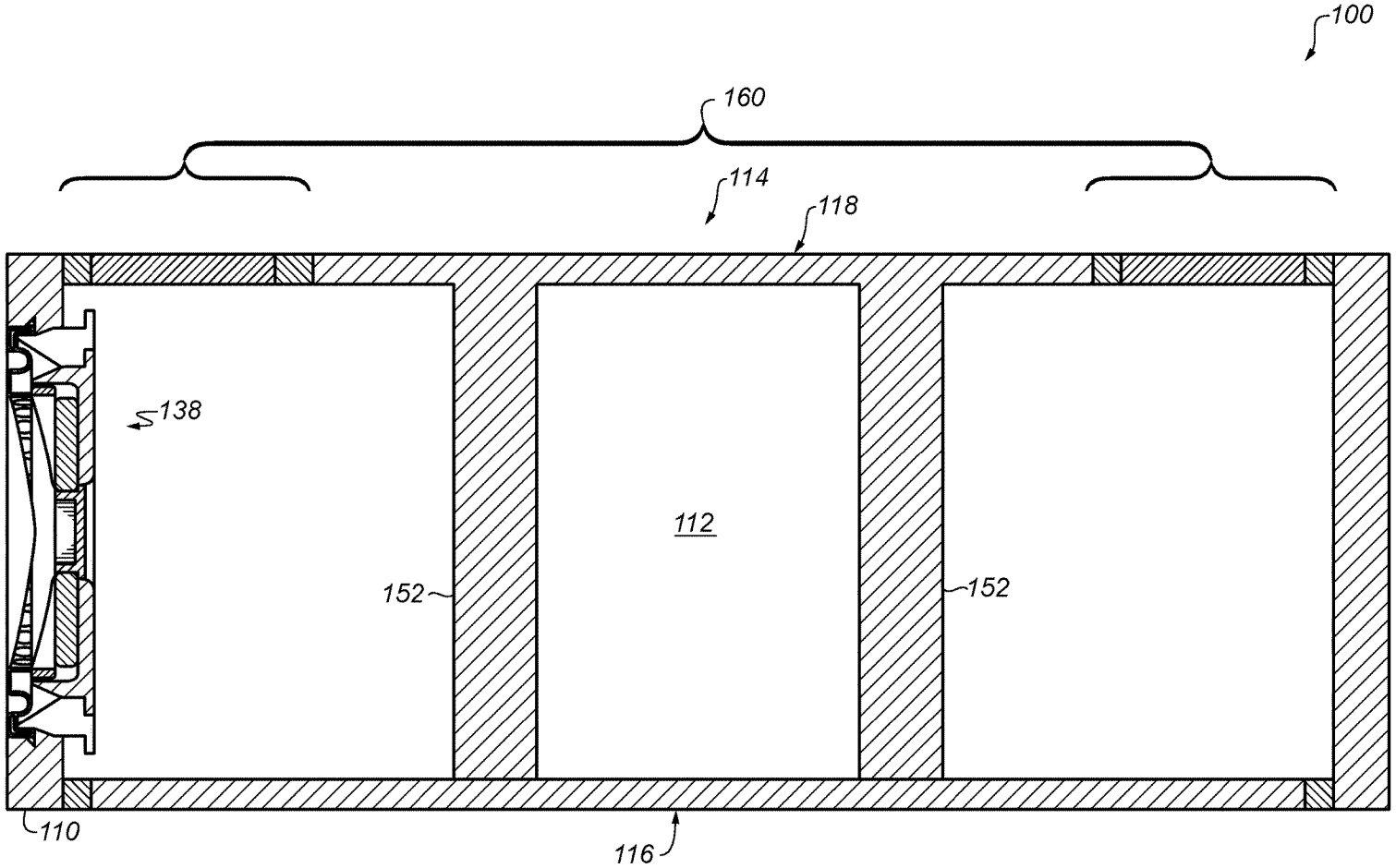
FIG. 3 is a cross-sectional side view of a third implementation of an acoustic device with passive radiators.

While an implementation has been described in which the active transducer is mounted to one of the coupled passive radiator diaphragms, other implementations are possible. For example, FIG. 3 illustrates an implementation in which the active transducer 138 is mounted directly to the enclosure 110, separately from the first passive radiator arrangement 114, which in FIG. 3 consists essentially of the first and second passive radiators 116, 118. The implementation of FIG. 3 remains substantially balanced so long as equations 1 and 3 are satisfied; and, here the radiating area of the active transducer 138 is not a part of the radiating area of the first passive radiator arrangement 114.

Figure 4:
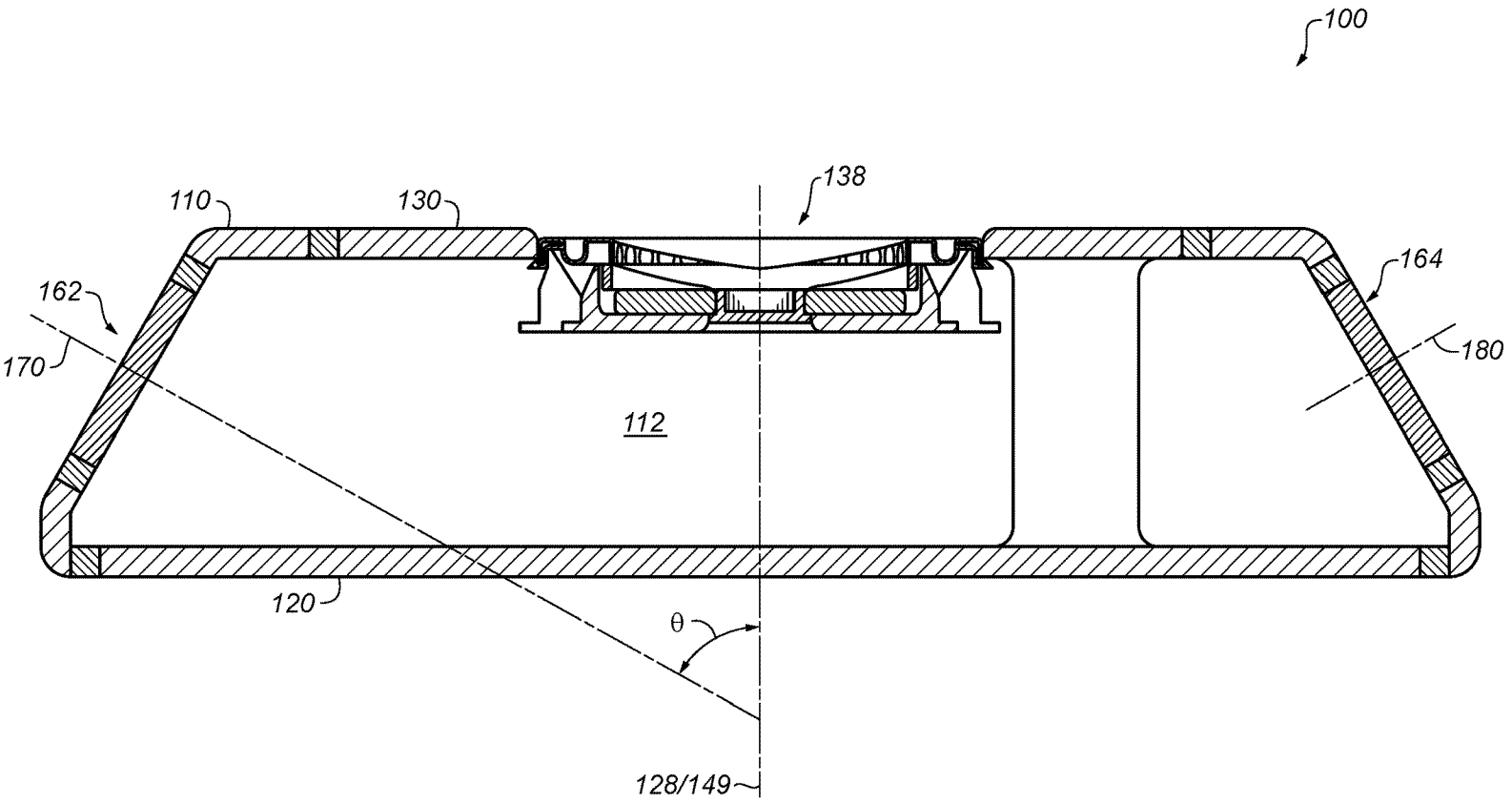
FIG. 4 is a cross-sectional side view of a fourth implementation of an acoustic device with passive radiators.

In the implementation illustrated in FIGS. 1A-1C, the third and fourth passive radiators are arranged along the same side of the enclosure as the second passive radiator, however, other configurations are possible. For example, FIG. 4 illustrates an implementation in which the third and fourth passive radiators 162, 164 of the second passive radiator arrangement are arranged on opposing sides of the enclosure 110 and at an angle (i.e., a non-zero angle) relative to the first and second passive radiator diaphragms 120, 130 (i.e., such that the vibration axes of the third and fourth passive radiators 162, 164 are at a non-zero angle (θ) relative to the vibration axis 128 of the first passive radiator arrangement). In the example illustrated in FIG. 4, the third and fourth passive radiators 162, 164 are each arranged an angle θ of approximately 60 degrees relative to the first passive radiator diaphragm 120. For the implementation illustrated in FIG. 4, the effective radiating area ($A_{eff2}$) is determined according to equation 4, below.

$$A_{eff2}=(A_3+A_4)\cos(\theta) \quad \text{(eq. 4)}$$

FIGS. 5A-5E illustrate a portable acoustic device 500 that implements the principles described above, and which is particularly adapted for use with a portable audio source, such as a mobile phone. The portable acoustic device 500 includes a housing 502 which provides enclosure 510 that defines an internal cavity 512. The acoustic device 510 also includes a low frequency acoustic assembly.

The low frequency acoustic assembly includes a first passive radiator arrangement 516 which includes first and second passive radiators 518, 520 arranged along opposite sides of the enclosure 510. The first passive radiator 518 includes a first passive radiator diaphragm 522 which is coupled to the enclosure 510 by a first suspension element 524. The first passive radiator diaphragm 522 has a rear surface which is exposed to the cavity 512, and a front surface which is open to the outside of the enclosure 510 such that it is able to radiate sound from the enclosure 510. The first passive radiator diaphragm 522 is constructed and arranged to vibrate relative to the enclosure 510 along vibration axis 530 in and out of the internal cavity 512. The first passive radiator diaphragm 522 may be an essentially flat plate as shown in the drawing or may have a different construction or form as is known in the art of passive radiator diaphragms.

The second passive radiator 520 includes a second passive radiator diaphragm 532 which is coupled to the enclosure 510 by a second suspension element 534, which allows the second passive radiator diaphragm 532 to move or vibrate in and out relative to the enclosure 510. The second passive radiator diaphragm 532 includes a rear surface which is exposed to the interior cavity 512, and a front surface which is exposed to the outside of the enclosure 510 such that it is able to radiate sound from the enclosure 510. As with the first passive radiator diaphragm 522, the second passive radiator diaphragm 532 may be an essentially flat plate as shown in the drawing or may have a different construction or form as is known in the art of passive radiator diaphragms.

An active electro-acoustic transducer 540 is mounted to the second passive radiator diaphragm 532 such that transducer 540 moves when the second passive radiator diaphragm 532 vibrates. The transducer 540 can be any known type of active acoustic transducer. In this non-limiting example transducer 540 includes a transducer diaphragm 542 (a/k/a "cone"), a bobbin with voice coil 544, a magnet/iron 546, a basket 548, and a surround 550. The surround 550 does not move at the tuning frequency of enclosure 510. Therefore, the active transducer 540 is part of the second passive radiator 520, and can be operated via audio signals (not shown) so as to radiate sound.

As in the example described above with respect to FIG. 2, the first and second passive radiators 518, 520 are rigidly coupled together via the basket 548 such that the first and second passive radiators 518, 520 move together relative to the enclosure 510 along a common motion axis 530, and such that as the first passive radiator diaphragm 522 is displaced outward away from the cavity 512 the second passive radiator diaphragm 532 is drawn into the cavity 512, and vice versa. In the illustrated example, the motion axis of the transducer 540 is coincident/coaxial with the motion axis 530.

In the illustrated example, the low frequency acoustic assembly also includes a second passive radiator arrangement 552, which includes third and fourth passive radiators 554, 556. The third passive radiator 554 includes a third passive radiator diaphragm 551 which is coupled to the enclosure 510 by a third suspension element 553, which allows the third passive radiator diaphragm 551 to move or vibrate in and out relative to the enclosure 510 along vibration axis 555 to help oppose forces exerted on the enclosure 510 attributable to motion of the first passive radiator arrangement 516. The third passive radiator diaphragm 551 includes a rear surface which is exposed to the interior cavity 512, and a front surface which is exposed to the outside of the enclosure 510 such that it is able to radiate sound from the enclosure 510.

Similarly, the fourth passive radiator 556 includes a fourth passive radiator diaphragm 557 which is coupled to the enclosure 510 by a fourth suspension element 559 which allows the fourth passive radiator diaphragm 557 to move or vibrate in and out relative to the enclosure 510 along vibration axis 561 to assist the third passive radiator 554 in opposing the forces exerted on the enclosure 510 due to motion of the first passive radiator arrangement 516. The fourth passive radiator diaphragm 557 includes a rear surface which is exposed to the interior cavity 512, and a front surface which is exposed to the outside of the enclosure 510 such that it is able to radiate sound from the enclosure 510. In the illustrated example, the second, third and fourth suspension elements 524,534, 553, and 559 are integrally formed. Axes 555 and 561 are substantially parallel, and both are substantially parallel to axis 530.

Once again, the first and second passive radiator arrangements 516, 552 satisfy equations 1 and 3 above so that substantially no net force is applied to the enclosure 510 due to the motion of the passive radiators 518, 520, 554, 556.

Figure 5A:
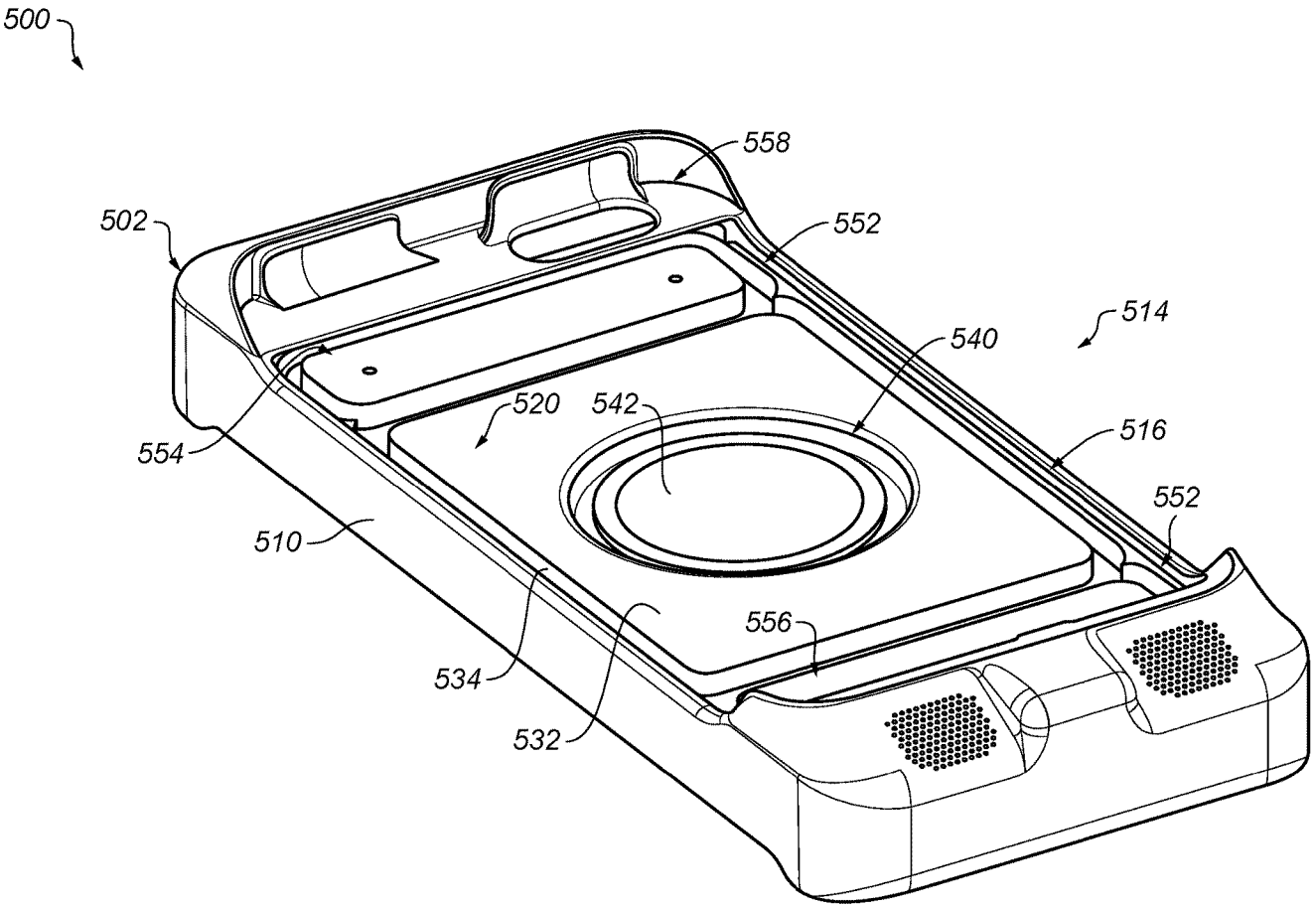
FIGS. 5A-5C a top perspective, bottom perspective, and cross-sectional side views, respectively, of a portable acoustic device with passive radiators, which is configured for supporting a portable audio source.
Figure 5B:
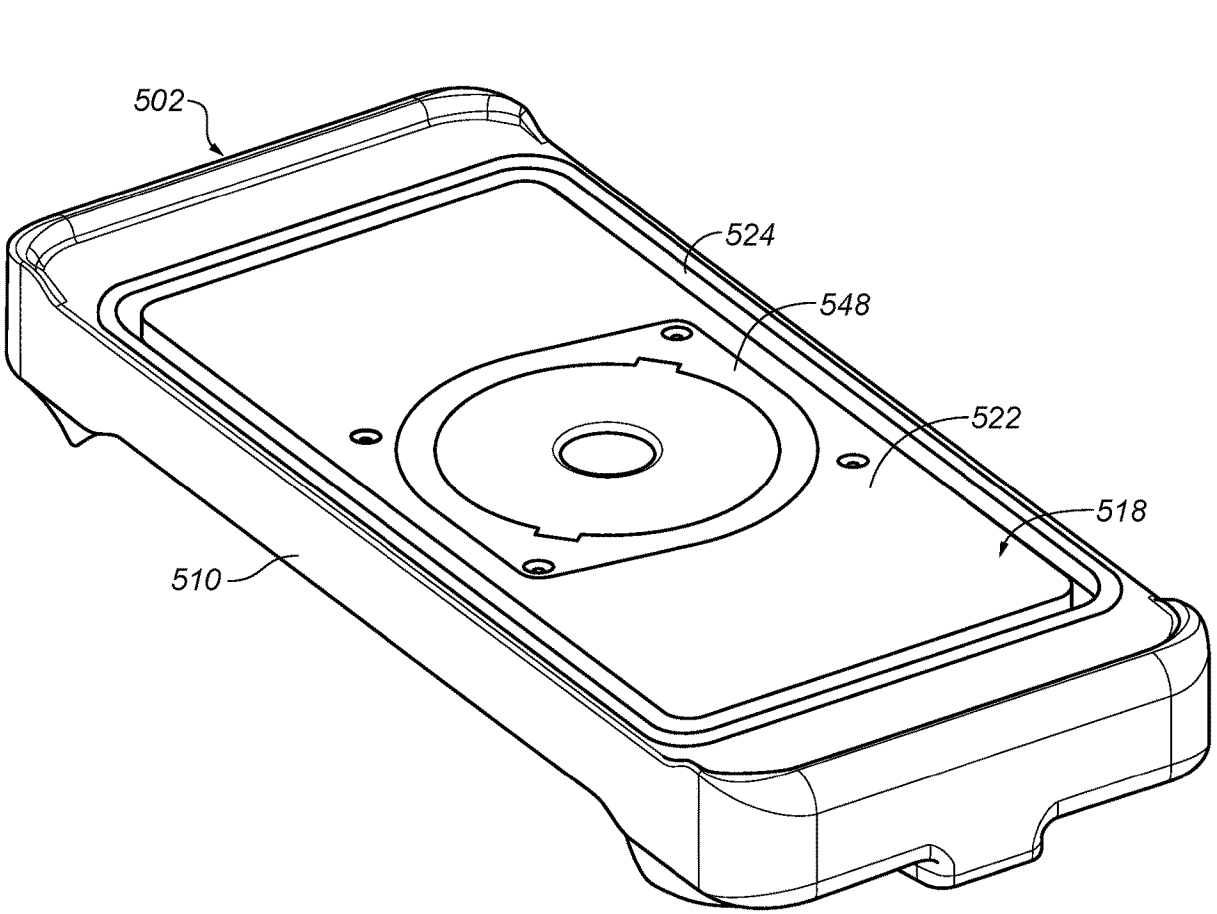
Figure 5C:
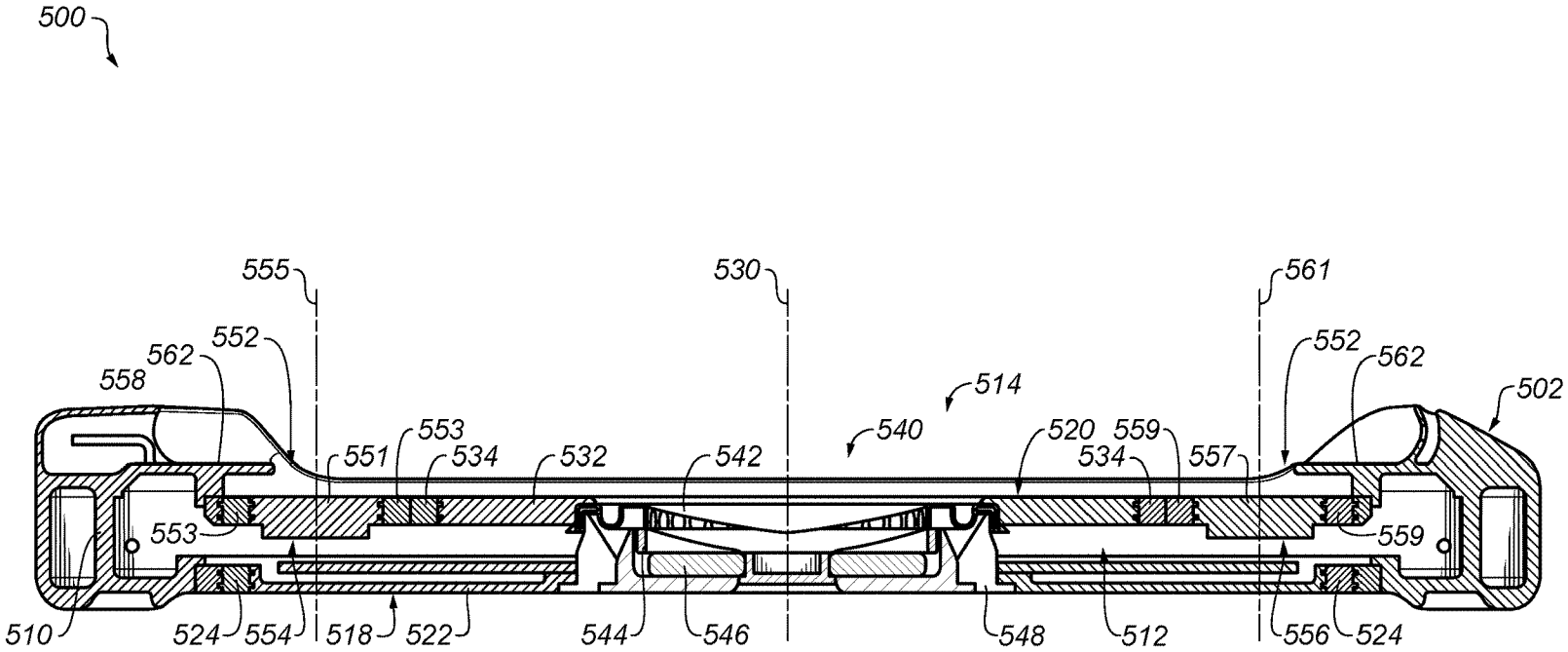
Figure 5D:
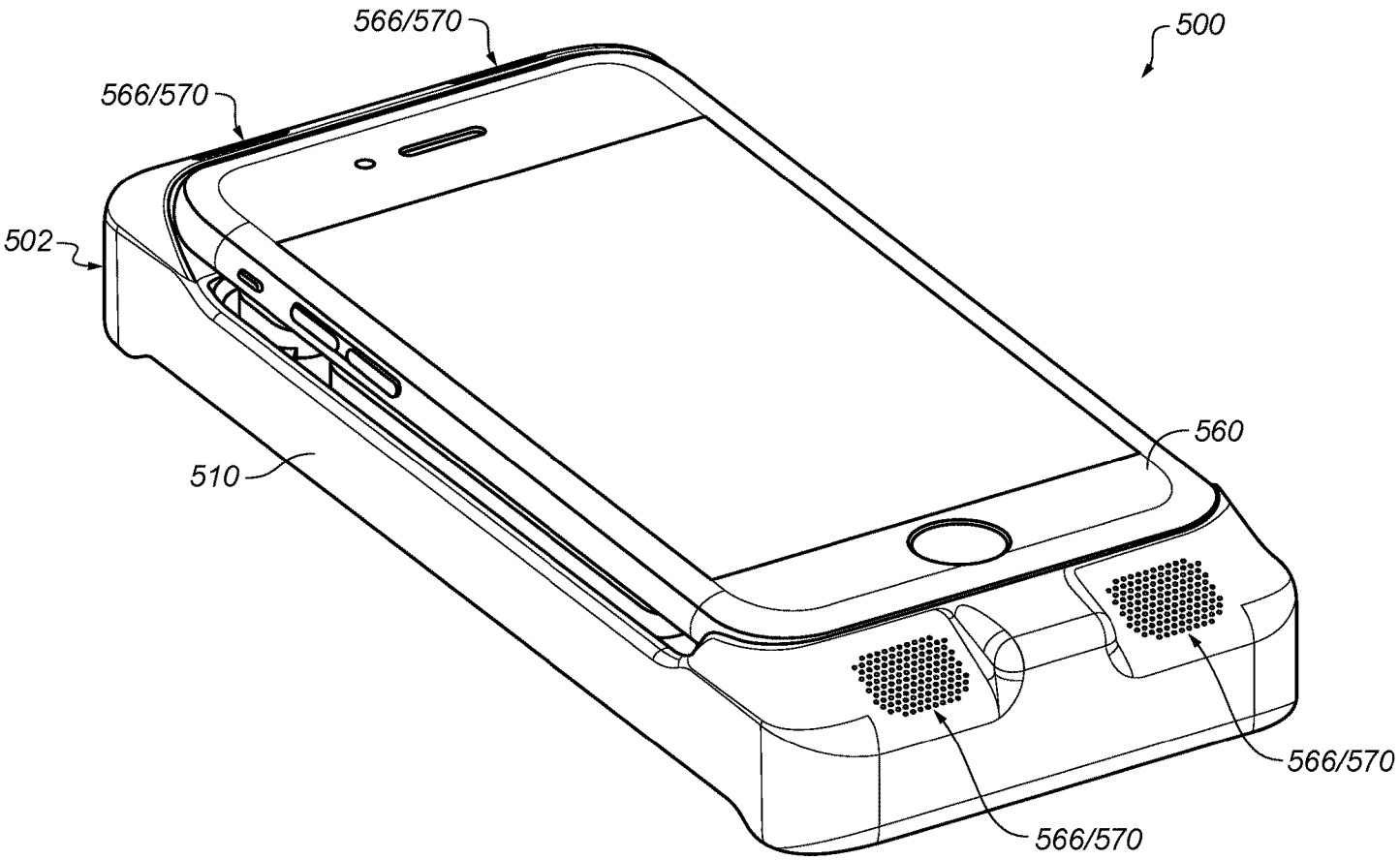
FIGS. 5D and 5E are top perspective and cross-sectional side views, respectively, of the portable acoustic device of FIGS. 5A-5C shown with a portable audio source.
Figure 5E:
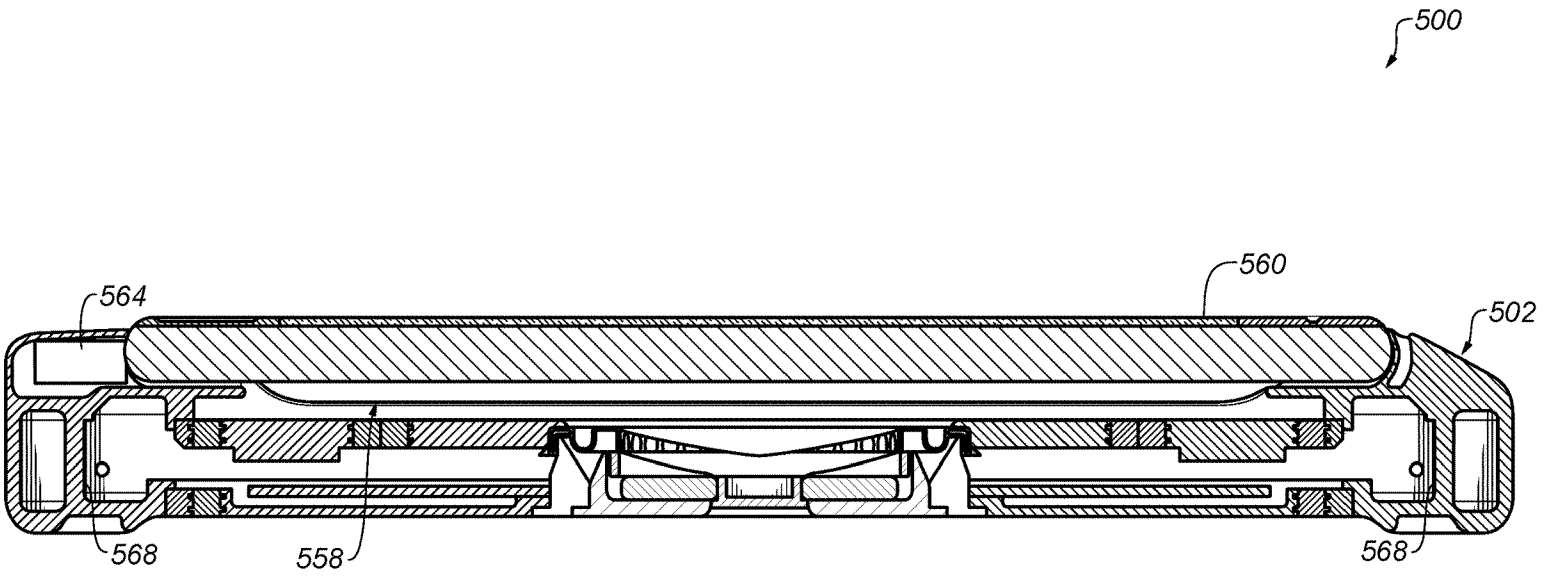
Figure 6A:
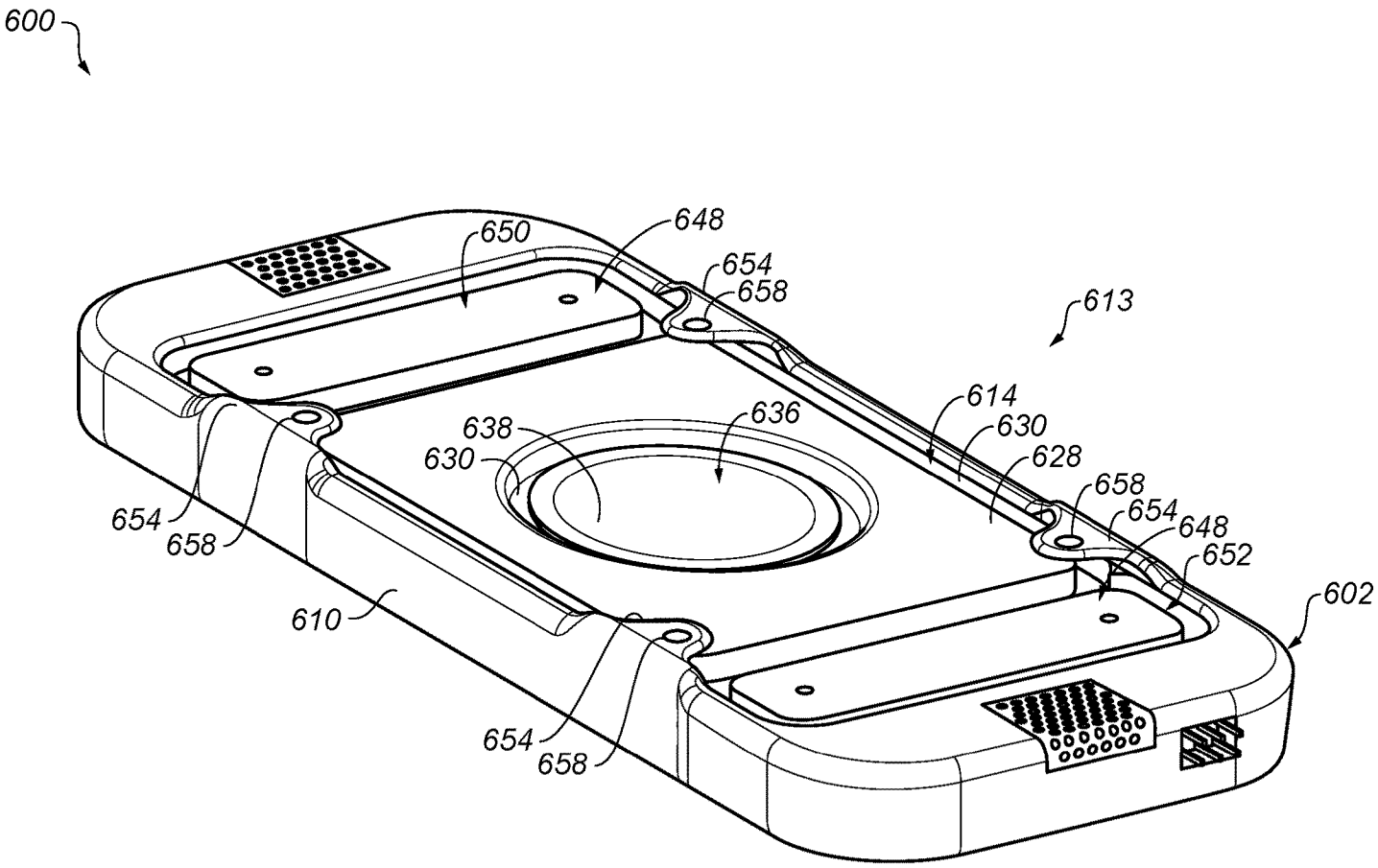
FIGS. 6A-6C are top perspective, bottom perspective, and cross-sectional side views, respectively, of a second implementation of a portable acoustic device with passive radiators, which is configured for supporting a portable audio source.
Figure 6B:
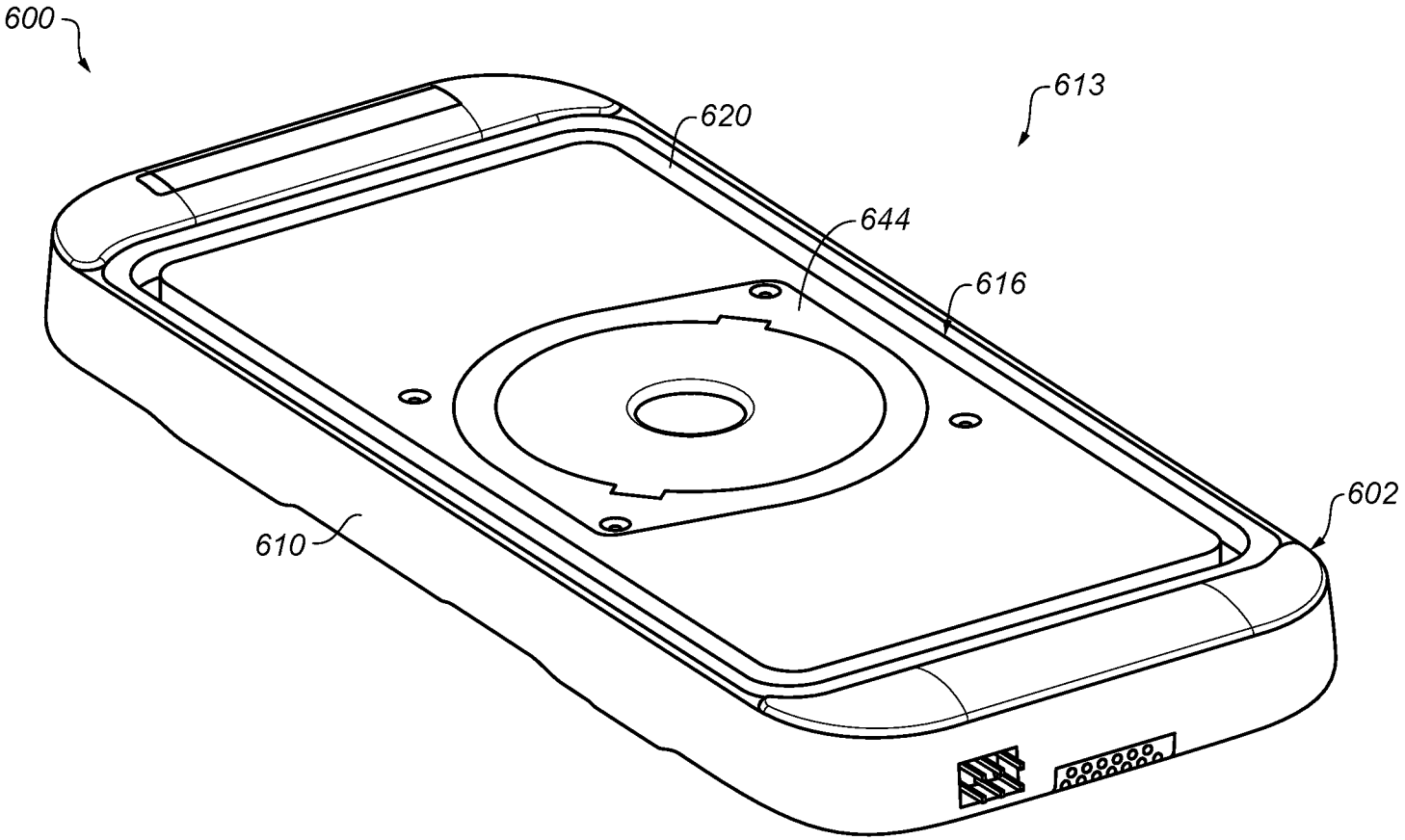
Figure 6C:
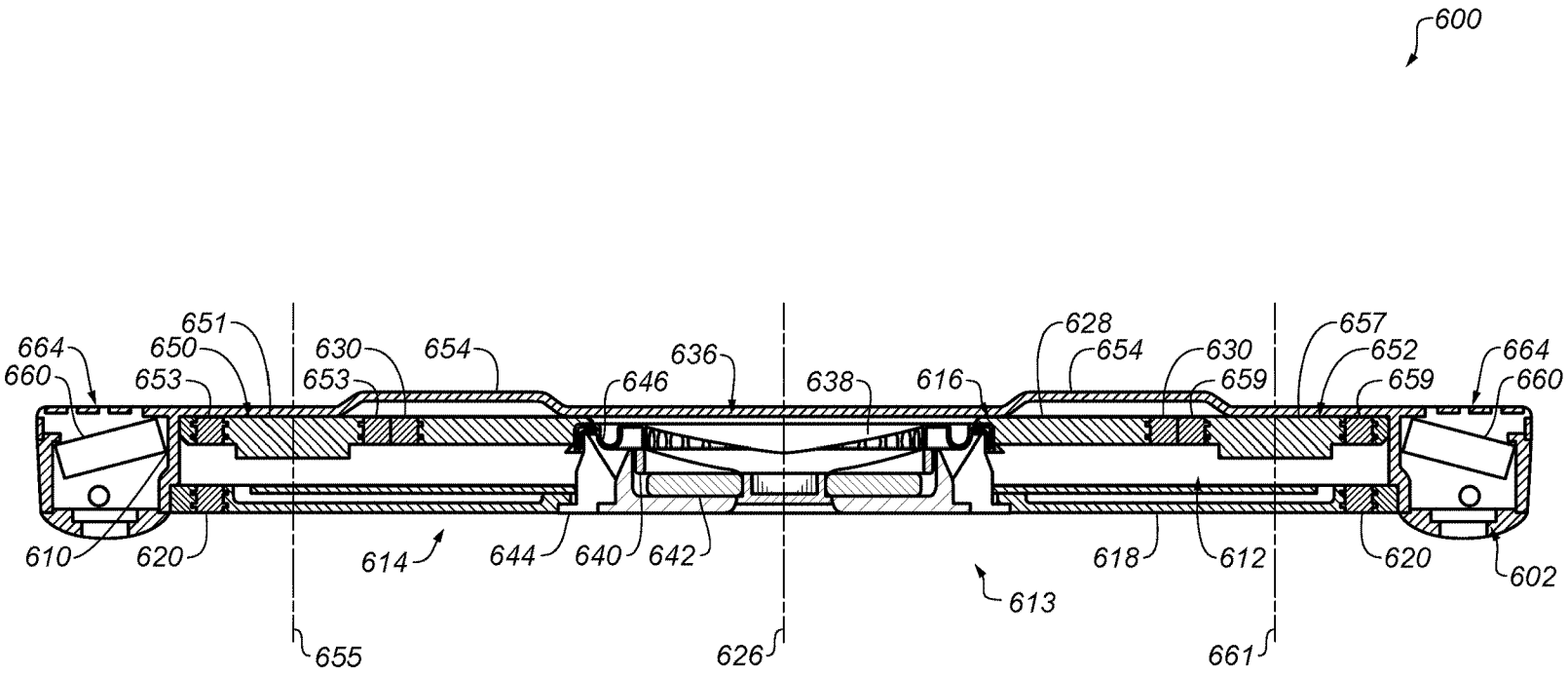
Figure 6D:
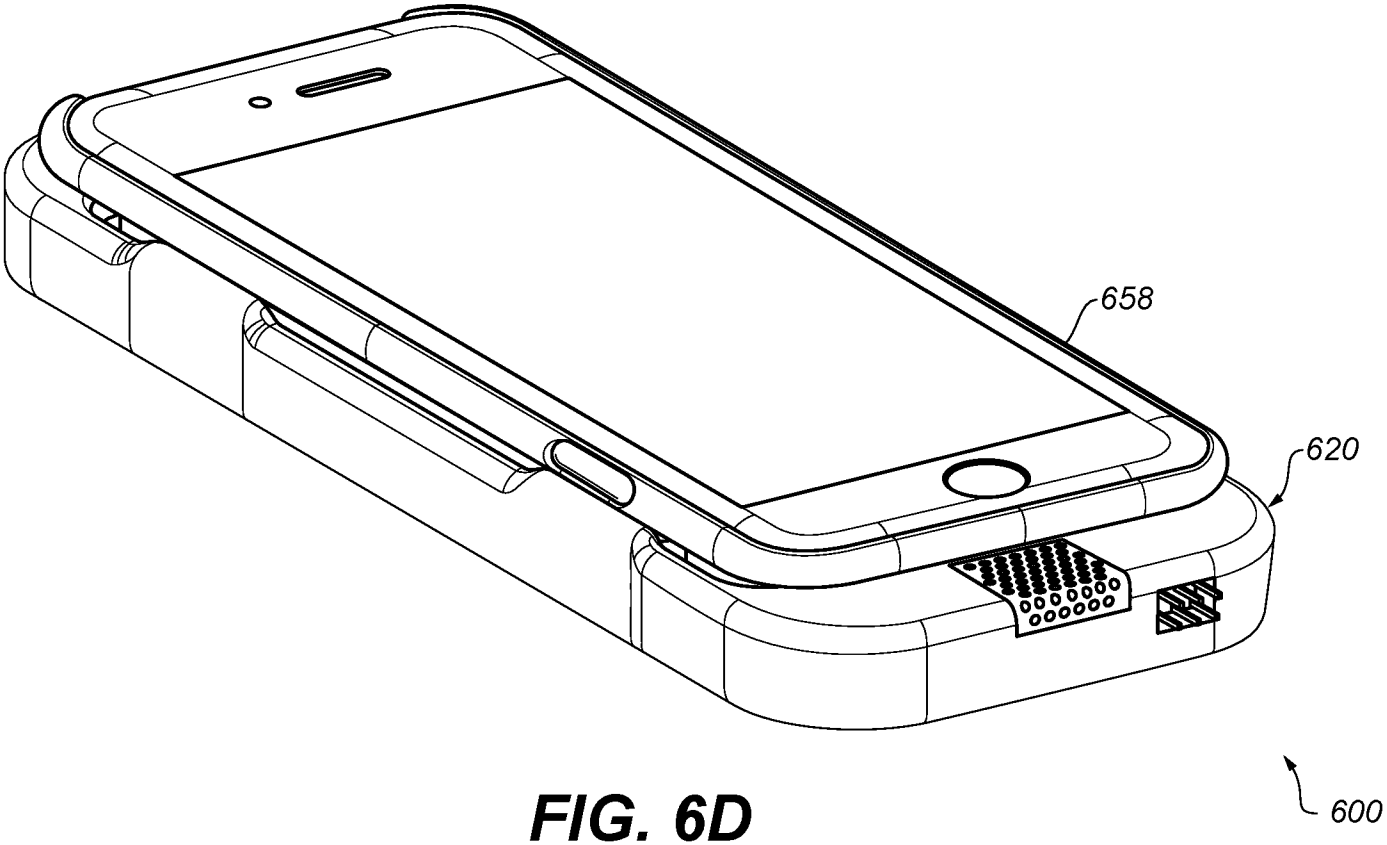
FIGS. 6D and 6E are top perspective and cross-sectional side views, respectively, of the portable acoustic device of FIGS. 6A-6C shown with a portable audio source.
Figure 6E:
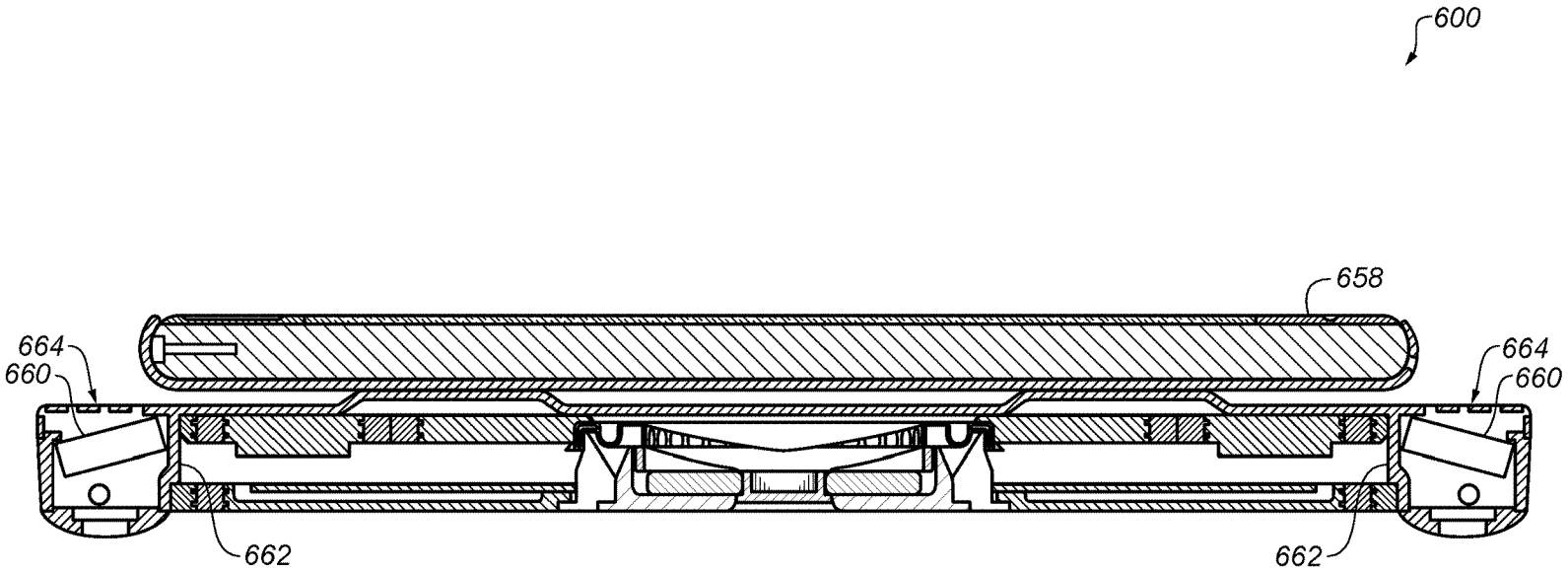

In the implementation illustrated in FIGS. 5A-5E, the housing 502 defines a pocket 558 which receives the mobile phone 560 (FIGS. 5D & 5E). The pocket 558 includes a pair of ledges 562 which support the mobile phone 560 in a suspended position above and completely out of contact with the active transducer 540, and the first and second passive radiator arrangements 516, 552. Decoupling the mobile phone 560 from the movement of the passive radiators can be beneficial particularly for mobile phones that include movable internal components (such as autofocus found on many modern mobile phone equipped with cameras) that can be excited into vibration, which can result in undesirable audio artifacts.

The housing 502 may also support an electrical connector 564 (e.g., a micro-USB connector) that extends into the pocket 558 and may support charging of the mobile phone 560 through the portable acoustic device 500. Another electrical connector (not shown) may be provided on an outer surface of the housing 502 to allow the electrical connector 564 to be powered from an external source.

The housing also supports a plurality of other electro-acoustic transducers 566. The other transducers 566 provide higher frequency acoustic output than what is provided by the low frequency acoustic assembly. The low frequency acoustic assembly may be configured to provide output in the range of about 40 Hz up to 5000 Hz, and the high frequency transducers 566 may be configured to provide audio in the range of about 400 Hz to about 20,000 Hz. This can enable the acoustic device to provide a full 2.1 sound system. The high frequency transducers 566 are acoustically isolated from the internal cavity 512 via sidewalls 568 of the enclosure 510. The housing defines grilles 570 which allow acoustic energy radiated from the high frequency transducers 566 to pass to the exterior of the housing 502.

The portable acoustic device 500 may further include a transceiver (e.g., a Bluetooth transceiver) for receiving streamed audio from the mobile phone 560. Alternatively or additionally, the portable acoustic device 500 may be configured to receive audio from the mobile phone 560 via the electrical connector 564.

FIGS. 6A-6E illustrate yet another portable acoustic device 600 that implements the principles described above, and which is adapted for use with a mobile phone. The portable acoustic device 600 includes a housing 602 which provides an enclosure 610 that defines an internal cavity 612. The acoustic device also includes a low frequency acoustic assembly.

The low frequency acoustic assembly includes a first passive radiator arrangement 612 which includes first and second passive radiators 614, 616 arranged along opposite sides of the enclosure 610. The first passive radiator 614 includes a first passive radiator diaphragm 618 which is coupled to the enclosure 610 by a first suspension element 620. The first passive radiator diaphragm 618 has a rear surface which is exposed to the cavity 612, and an exterior (front) surface 624 which is open to the outside of the enclosure 610 such that it is able to radiate sound from the enclosure 610. The first passive radiator diaphragm 618 is constructed and arranged to vibrate relative to the enclosure 610 along vibration axis 626 in and out of the cavity 612. The first passive radiator diaphragm 618 may be an essentially flat plate as shown in the drawing or may have a different construction or form as is known in the art of passive radiator diaphragms.

The second passive radiator 616 includes a second passive radiator diaphragm 628 which is coupled to the enclosure 610 by a second suspension element 630, which allows the second passive radiator diaphragm 628 to move or vibrate in and out relative to the enclosure 610. The second passive radiator diaphragm 628 includes a rear surface which is exposed to the interior cavity 612, and a front surface which is exposed to the outside of the enclosure 610 such that it is able to radiate sound from the enclosure 610. As with the first passive radiator diaphragm 618, the second passive radiator diaphragm 628 may be an essentially flat plate as shown in the drawing or may have a different construction or form as is known in the art of passive radiator diaphragms.

An active electro-acoustic transducer 636 is mounted to the second passive radiator diaphragm 628 such that transducer 636 moves when the second passive radiator diaphragm 628 vibrates. The transducer 636 can be any known type of active acoustic transducer. In this non-limiting example transducer 636 includes a transducer diaphragm 638, a bobbin with voice coil 640, a magnet/iron 642, a basket 644, and a surround 646. The surround 646 does not move at the tuning frequency of enclosure 610. Therefore, the active transducer 636 is part of the second passive radiator 616, and can be operated via audio signals (not shown) so as to radiate sound.

As in the example described above with respect to FIG. 2, the first and second passive radiators 614, 616 are rigidly coupled together via the basket 644 such that the first and second passive radiators 614, 616 move together relative to the enclosure 610 along a common motion axis 626, and such that as the first passive radiator diaphragm 618 is displaced outward away from the cavity 612 the second passive radiator diaphragm 628 is drawn into the cavity 612, and vice versa. In the illustrated example, the motion axis of the transducer 636 is coincident/coaxial with the motion axis 626.

In the illustrated example, the low frequency acoustic assembly also includes a second passive radiator arrangement 648 which includes third and fourth passive radiators 650, 652. The third passive radiator 650 includes a third passive radiator diaphragm 651 which is coupled to the enclosure 610 by a third suspension element 653, which allows the third passive radiator diaphragm 651 to move or vibrate in and out relative to the enclosure 610 along vibration axis 655 to help oppose forces exerted on the enclosure 610 attributable to motion of the first passive radiator arrangement 613. The third passive radiator diaphragm 651 includes a rear surface which is exposed to the interior cavity 612, and a front surface which is exposed to the outside of the enclosure 610 such that it is able to radiate sound from the enclosure 610.

Similarly, the fourth passive radiator 652 includes a fourth passive radiator diaphragm 657 which is coupled to the enclosure 610 by a fourth suspension element 659 which allows the fourth passive radiator diaphragm 657 to move or vibrate in and out relative to the enclosure 610 along vibration axis 661 to assist the third passive radiator 650 in opposing the forces exerted on the enclosure 610 due to motion of the first passive radiator arrangement 613. The fourth passive radiator diaphragm 657 includes a rear surface which is exposed to the interior cavity 612, and a front surface which is exposed to the outside of the enclosure 610 such that it is able to radiate sound from the enclosure 610. In the illustrated example, the second, third and fourth suspension elements 620, 630, 653, and 659 are integrally formed (e.g., from a single piece of molded elastomer). Axes 655 and 661 are substantially parallel, and both are substantially parallel to axis 626.

Once again, the first and second passive radiator arrangements 613, 648 satisfy equations 1 and 3 above so that substantially no net force is applied to the enclosure 610 due to the motion of the passive radiators 614, 616, 650, 652. In the implementation illustrated in FIGS. 6A-6E, the housing 602 defines a plurality of standoffs 654 for supporting a mobile phone 656 (FIGS. 6D & 6E) in a suspended position above and completely out of contact with the active transducer 636, and the first and second passive radiator arrangements 613. In the illustrated example, magnets 658 are provided in the standoffs 654 to enable a magnetic coupling to a metal backing of the mobile phone 656.

Once again, in the implementation illustrated in FIGS. 6A-6E, the active transducer 636 is the dominant mass, and, consequently, the first passive radiator arrangement 613 will move less (i.e., motion is inversely proportional to mass) than the second passive radiator arrangement 648, and the movement of the second passive radiator arrangement 648 will contribute more to the acoustic output.

The housing 602 also supports a pair of high frequency electro-acoustic transducers 660. The other transducers 660 provide higher frequency acoustic output than what is provided by the low frequency acoustic assembly. The high frequency transducers 660 are acoustically isolated from the internal cavity 612 via sidewalls 662 of the enclosure 610.

As with the implementation described above with respect to FIGS. 5A-5E, the housing 602 defines grilles 664 which allow acoustic energy radiated from the high frequency transducers 660 to pass to the exterior of the housing 602. However, unlike the implementation of FIGS. 5A-5E, in which the high frequency transducers 566 are arranged on either side of the longitudinal axis of the housing 502, here the high frequency transducers 660 are arranged on the longitudinal axis of the housing 602. Placing the high frequency transducers off-axis (as in the implementation of FIGS. 5A-5E) allows the design to include more transducers which can allow for greater output. However, in some circumstances, such as when a listener is posited at an angle relative to the longitudinal axis of the housing, the respective outputs from the off-axis transducers can interfere with one another, and, as a result, the frequency response will be dependent on that angle. The on-axis arrangement of the transducers (as in the implementation of FIGS. 6A-6E) provides more consistent response regardless of the position of the listener, and, thus, may be preferable in some circumstances.

FIGS. 7A-7E illustrate another implementation of a portable acoustic device 700 that implements the principles described above, and which is adapted for coupling with a mobile phone. The portable acoustic device 700 includes a housing 702 which provides enclosure 710 that defines an internal cavity 712. The acoustic device 700 also includes a low frequency acoustic assembly.

The low frequency acoustic assembly includes a first passive radiator arrangement 714 which includes first and second passive radiators 716, 718 arranged along opposite sides of the enclosure 710. The first passive radiator 716 includes a first passive radiator diaphragm 720 which is coupled to the enclosure 710 by a first suspension element 722. The first passive radiator diaphragm 720 has a rear surface which is exposed to the cavity 712, and a front surface which is open to the outside of the enclosure 710 such that it is able to radiate sound from the enclosure 710. The first passive radiator diaphragm 720 is constructed and arranged to vibrate relative to the enclosure 710 along vibration axis 728 in and out of the internal cavity 712. The first passive radiator diaphragm 720 may be an essentially flat plate as shown in the drawing or may have a different construction or form as is known in the art of passive radiator diaphragms.

The second passive radiator 718 includes a frame 730 for coupling to an active electro-acoustic transducer 732. In this case, the frame 730 serves as a diaphragm (i.e., a second passive radiator diaphragm) with minimal radiating area. The frame 730 (hereinafter "the second passive radiator diaphragm") is coupled to the enclosure 710 by a second suspension element 734, which allows the second passive radiator diaphragm 730 to move or vibrate in and out relative to the enclosure 710.

The active electro-acoustic transducer 732 is mounted to the second passive radiator diaphragm 730 such that transducer 732 moves when the second passive radiator diaphragm 730 vibrates. The transducer 732 can be any known type of active acoustic transducer. In this non-limiting example transducer 732 includes a transducer diaphragm 736, a bobbin with voice coil 738, a magnet/iron 740, a basket 742, and a surround 744. The surround 744 does not move at the tuning frequency of enclosure 710. Therefore, the active transducer 732 is part of the second passive radiator 718, and can be operated via audio signals (not shown) so as to radiate sound.

Once again, the first and second passive radiators 716, 718 are rigidly coupled together via the basket 742 such that the first and second passive radiators 716, 718 move together relative to the enclosure 710 along a common motion axis 728 and such that as the first passive radiator diaphragm 720 is displaced outward away from the cavity 712 the second passive radiator diaphragm 730 is drawn into the cavity 712, and vice versa. In the illustrated example, the motion axis of the transducer 732 is coincident/coaxial with the motion axis 728.

Figure 7A:
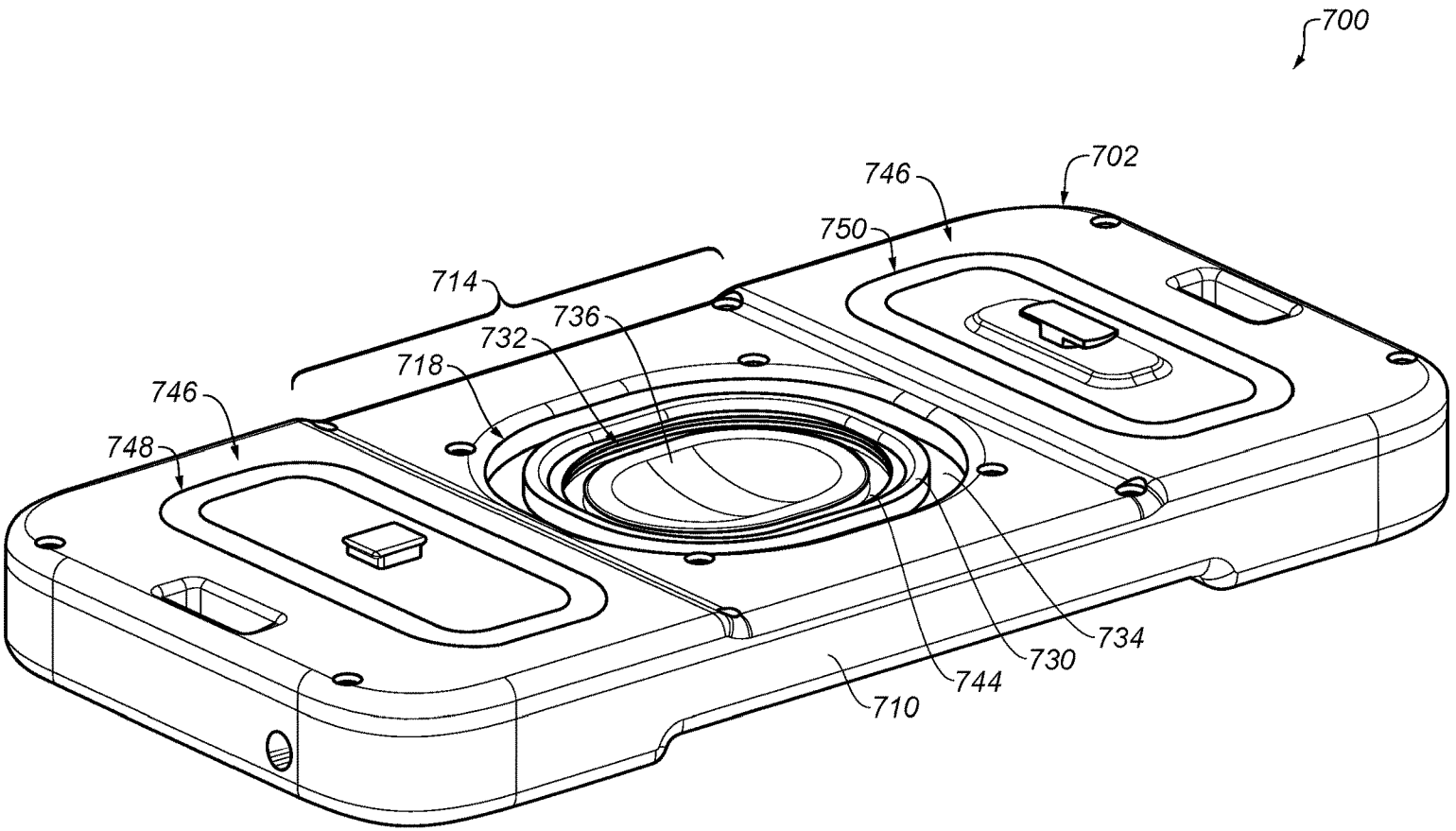
FIGS. 7A-7C a top perspective, bottom perspective, and cross-sectional side views, respectively, of a third implementation of a portable acoustic device with passive radiators, which is configured for supporting a portable audio source.
Figure 7B:
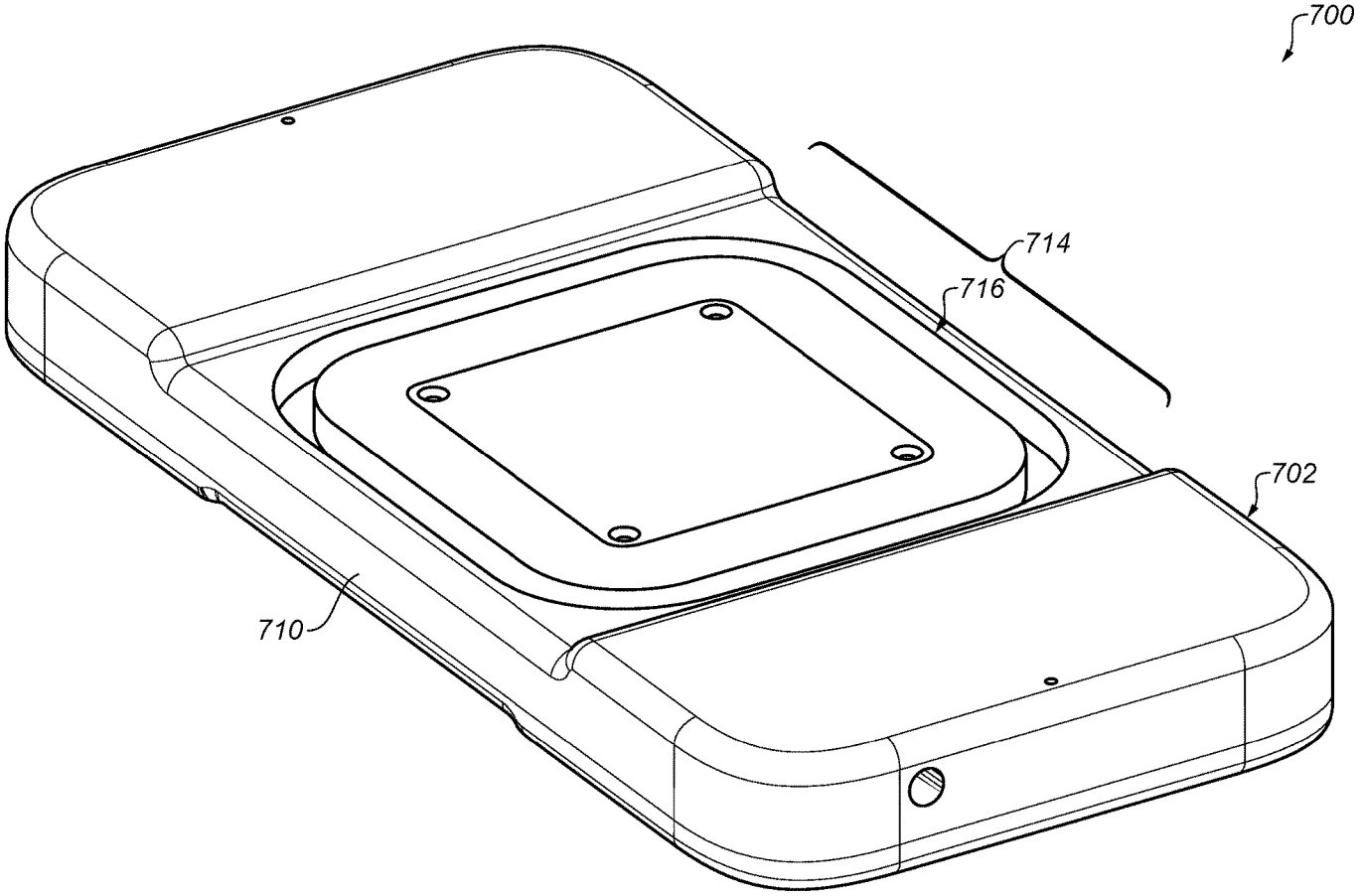
Figure 7C:
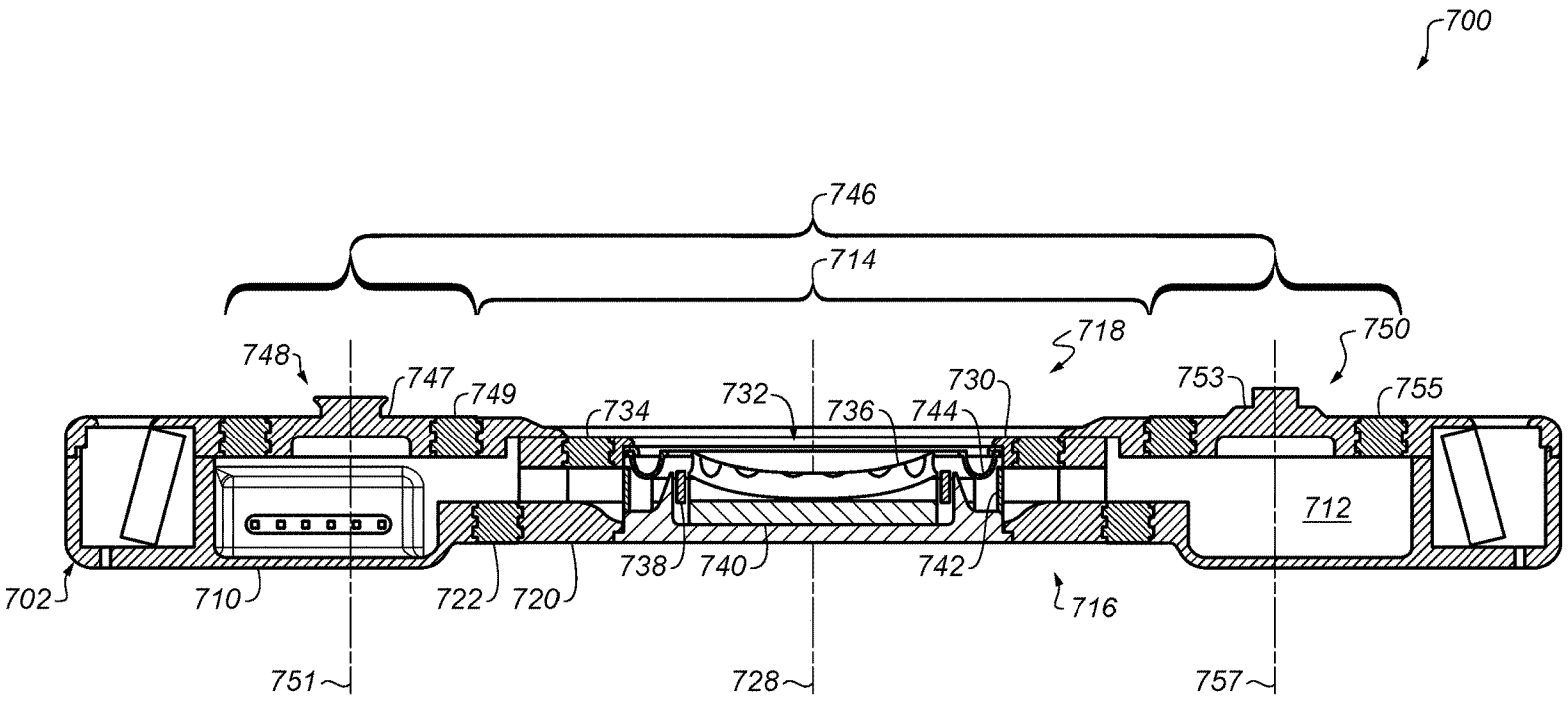
Figure 7D:
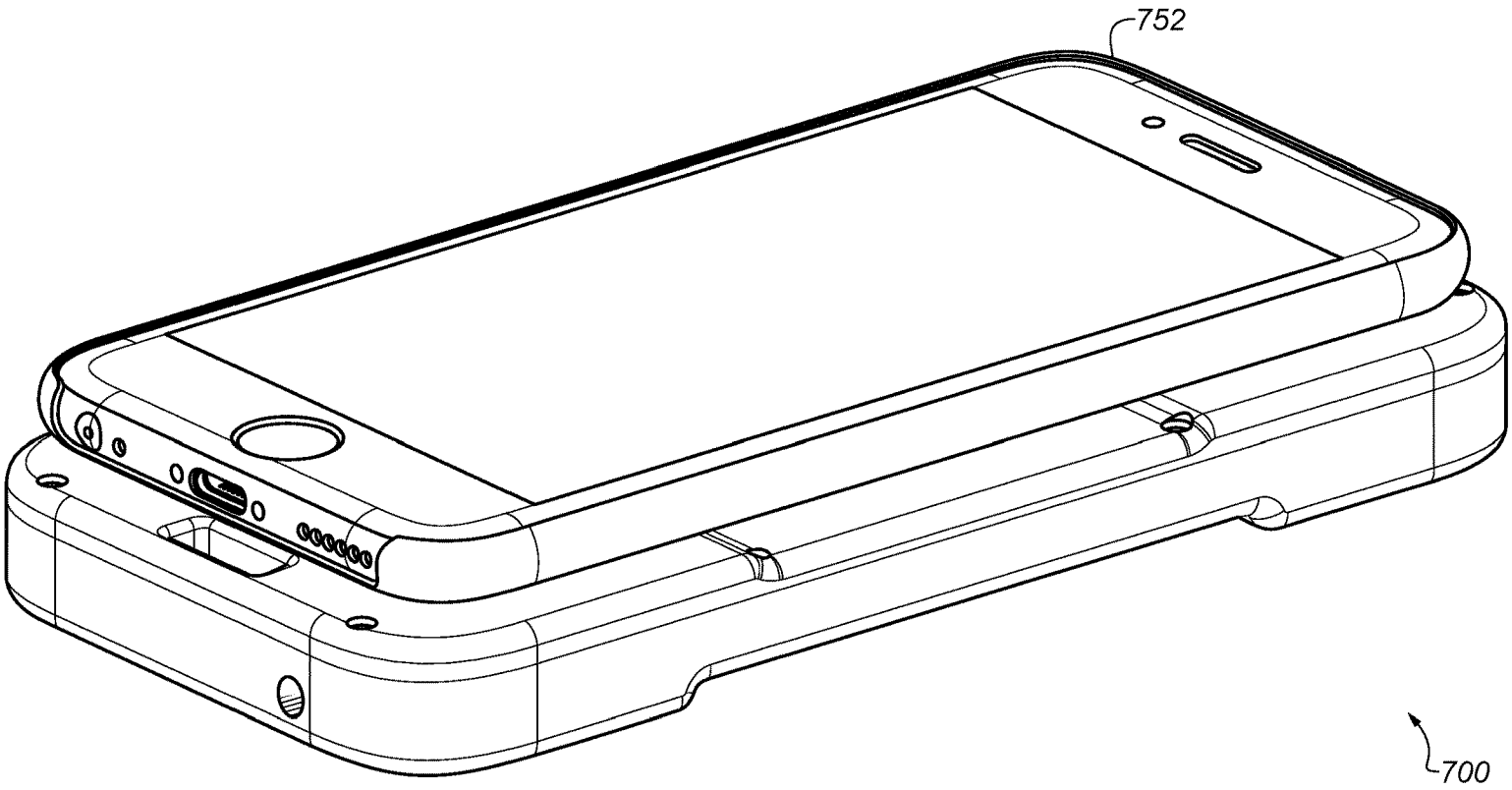
FIGS. 7D and 7E are top perspective and cross-sectional side views, respectively, of the portable acoustic device of FIGS. 7A-7C shown with a portable audio source.
Figure 7E:
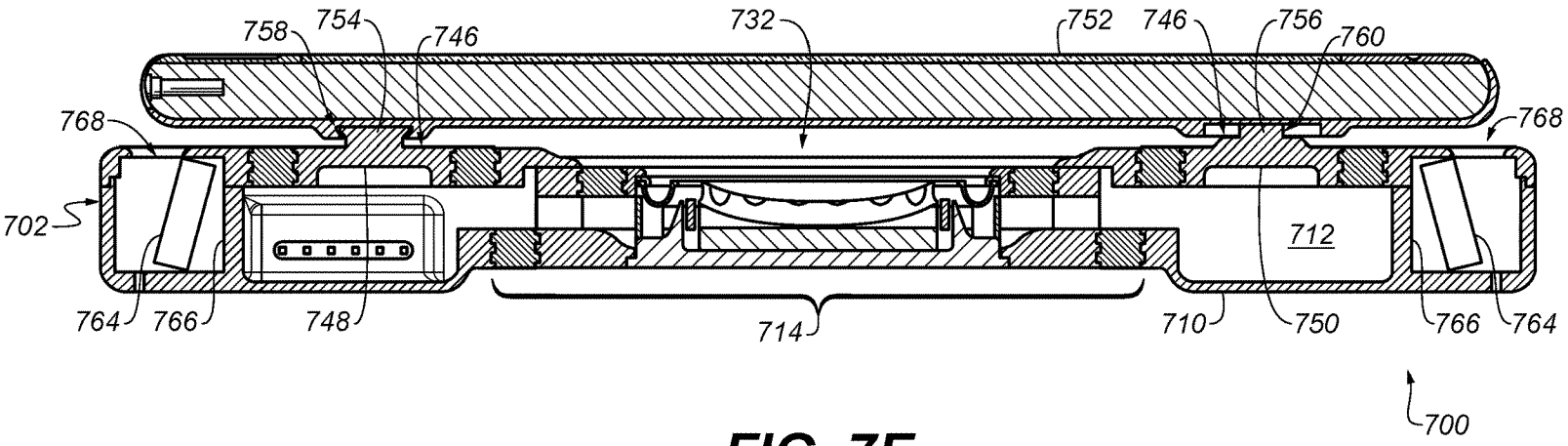

The low frequency acoustic assembly also includes a second passive radiator arrangement 746, which includes third and fourth passive radiators 748, 750. The third and fourth passive radiators 748, 750 are arranged to support a mobile phone 752. In this regard the third and fourth passive radiator diaphragms 748, 750 include protrusions 754, 756 (FIG. 7E) that extend outwardly from their respective front surfaces. In this example, the protrusions 754, 756 are configured for locking engagement with mating features 758, 760 on the mobile phone 752. As shown in FIG. 7E, the mating features 758, 760 may be provided by a case 762 that holds the mobile phone 752. The protrusions 754, 756 hold the mobile phone 752 in a suspended position above the active transducer 732 and completely out of contact with the first passive radiator arrangement 714.

The movements of the third and fourth passive radiator diaphragms 748, 750 are coupled via the mobile phone 752, and the mobile phone 752 contributes to the effective mass of the second passive radiator arrangement 746.

In the illustrated example, the low frequency acoustic assembly also includes a second passive radiator arrangement 746 which a pair of passive radiators (i.e., third and fourth passive radiators 748, 750). The third passive radiator 748 includes a third passive radiator diaphragm 747 which is coupled to the enclosure 710 by a third suspension element 749, which allows the third passive radiator diaphragm 747 to move or vibrate in and out relative to the enclosure 710 along vibration axis 751 to help oppose forces exerted on the enclosure 710 attributable to motion of the first passive radiator arrangement 714. The third passive radiator diaphragm 747 includes a rear surface which is exposed to the interior cavity 712, and a front surface which is exposed to the outside of the enclosure 710 such that it is able to radiate sound from the enclosure 710.

Similarly, the fourth passive radiator 750 includes a fourth passive radiator diaphragm 753 which is coupled to the enclosure 710 by a fourth suspension element 755 which allows the fourth passive radiator diaphragm 753 to move or vibrate in and out relative to the enclosure 710 along vibration axis 757 to assist the third passive radiator 748 in opposing the forces exerted on the enclosure 710 due to motion of the first passive radiator arrangement 714. The fourth passive radiator diaphragm 753 includes a rear surface which is exposed to the interior cavity 712, and a front surface which is exposed to the outside of the enclosure 710 such that it is able to radiate sound from the enclosure 710. In the illustrated example, the second, third and fourth suspension elements 722, 734, 749 and 755 are integrally formed (e.g., formed from a common piece of elastomer). Axes 751 and 757 are substantially parallel, and both are substantially parallel to axis 728.

In this implementation, due to the relatively heavy mass of the mobile phone 752, the first passive radiator arrangement 714 assumes the role of the lighter passive radiator arrangement. The lighter, first passive radiator arrangement 714 will move more than the second passive radiator arrangement 746, to ensure that the inertial forces are equal and that the system remains balances, and it will contribute more to the acoustic output than the heavier, second passive radiator arrangement 746. Still, the first and second passive radiator arrangements 714, 746 satisfy equations 1 and 3 above so that substantially no net force is applied to the enclosure 710 due to the motion of the passive radiators 716, 718, 748, 750.

Once again, the housing 702 supports a plurality of high frequency electro-acoustic transducers 764, which provide high frequency output to supplement the low frequency output of the low frequency acoustic assembly. The high frequency transducers 764 are acoustically isolated from the internal cavity 712 via sidewalls 766 of the enclosure 710. The housing defines openings 768 which allow acoustic energy radiated from the high frequency transducers 764 to pass to the exterior of the housing 702.

Figure 7F:
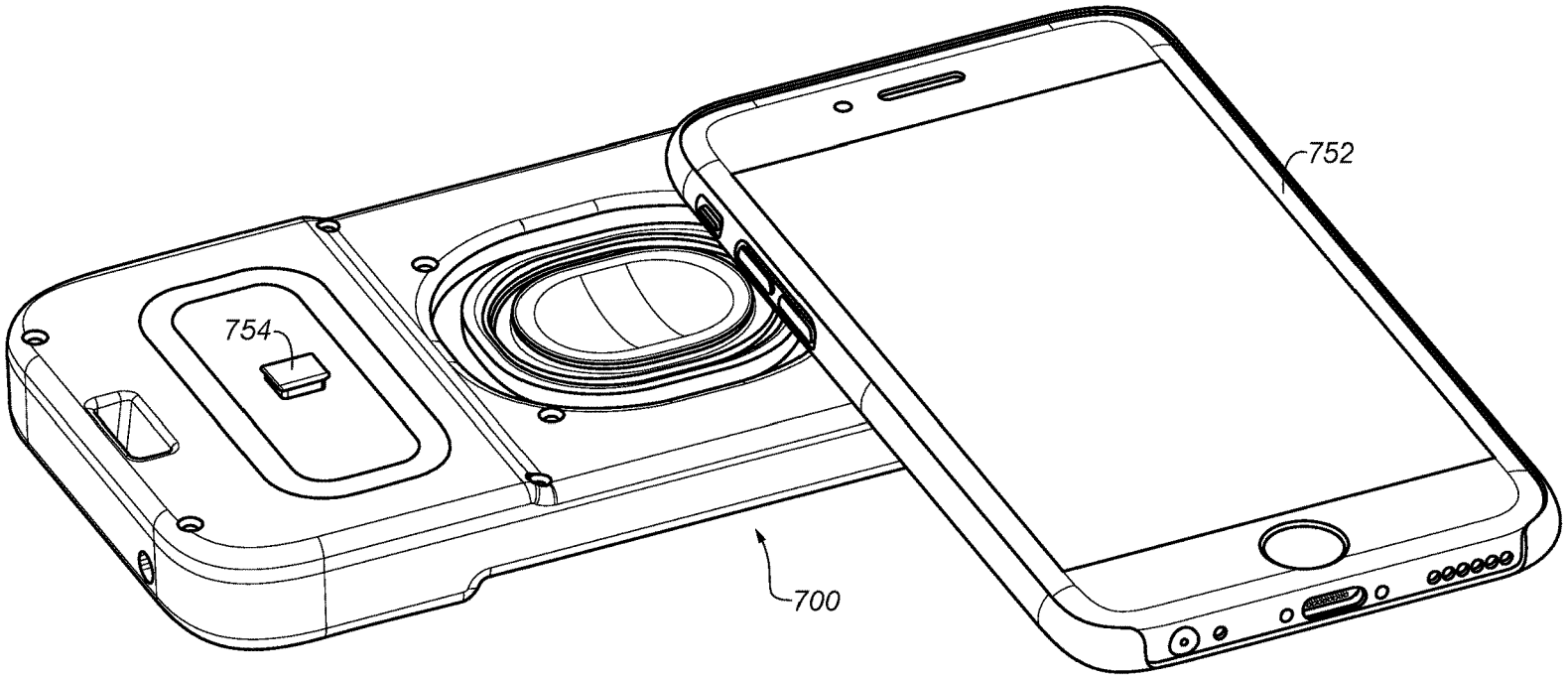
FIGS. 7G and 7F are top perspective views of the portable audio device and portable audio source of FIGS. 7D and 7E illustrating separation of the portable audio source from the portable audio device.
Figure 7G:
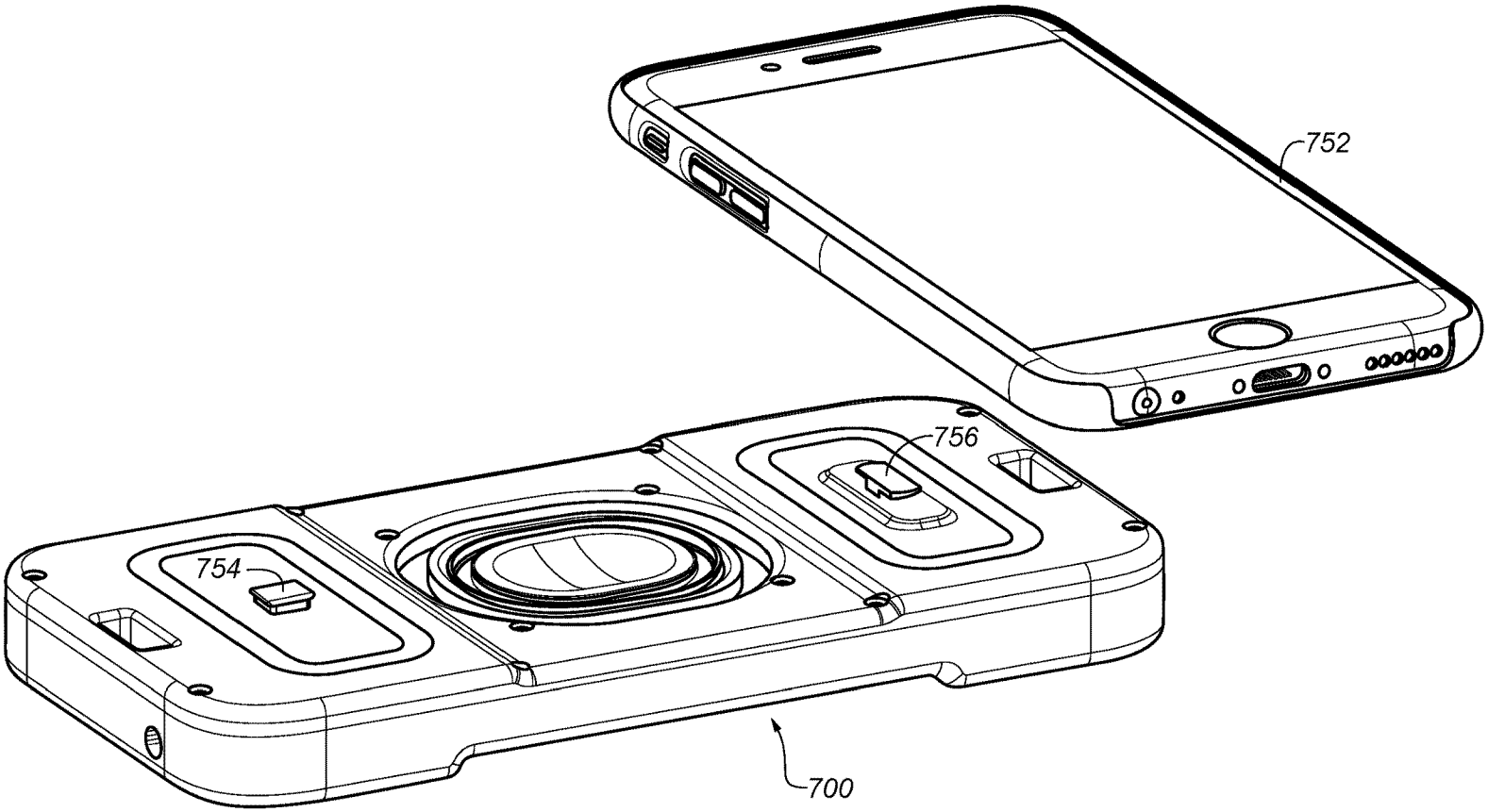

With reference to FIGS. 7F and 7G, the mobile phone 752 is separated from the acoustic device 700 by rotating the mobile phone 752 90 degrees (FIG. 7F), thereby disengaging the protrusions 754, 756 from the mating features 758, 760 (FIG. 7E), and then lifting the mobile phone 752 up to detach the phone 752 from the portable acoustic device 700 (FIG. 7G). The mobile phone 752 is attached in the reverse order.

While some implementations have been described in which the second passive radiator arrangement comprises a pair of discrete passive radiators for balancing the forces applied by the first passive radiator arrangement, other implementations are possible. For example, in some implementations, the second passive radiator arrangement may consist of a single annular passive radiator that circumferentially surrounds the passive radiator that carries the active transducer. As one non-limiting example, the third passive radiator diaphragm could be annular and define a central opening that is larger than the second passive radiator diaphragm which carries the active transducer, so that the two diaphragms could be co-planar.

The principle captured in equation 3 regarding the balancing of stiffness to mass ratios is equally applicable to implementations in which the passive radiator that carries the active transducer is not rigidly coupled to another passive radiator, such as in the implementations described in U.S. application Ser. No. 14/226,587, filed Mar. 26, 2014, the complete disclosure of which is incorporated herein by reference.

Figure 8:
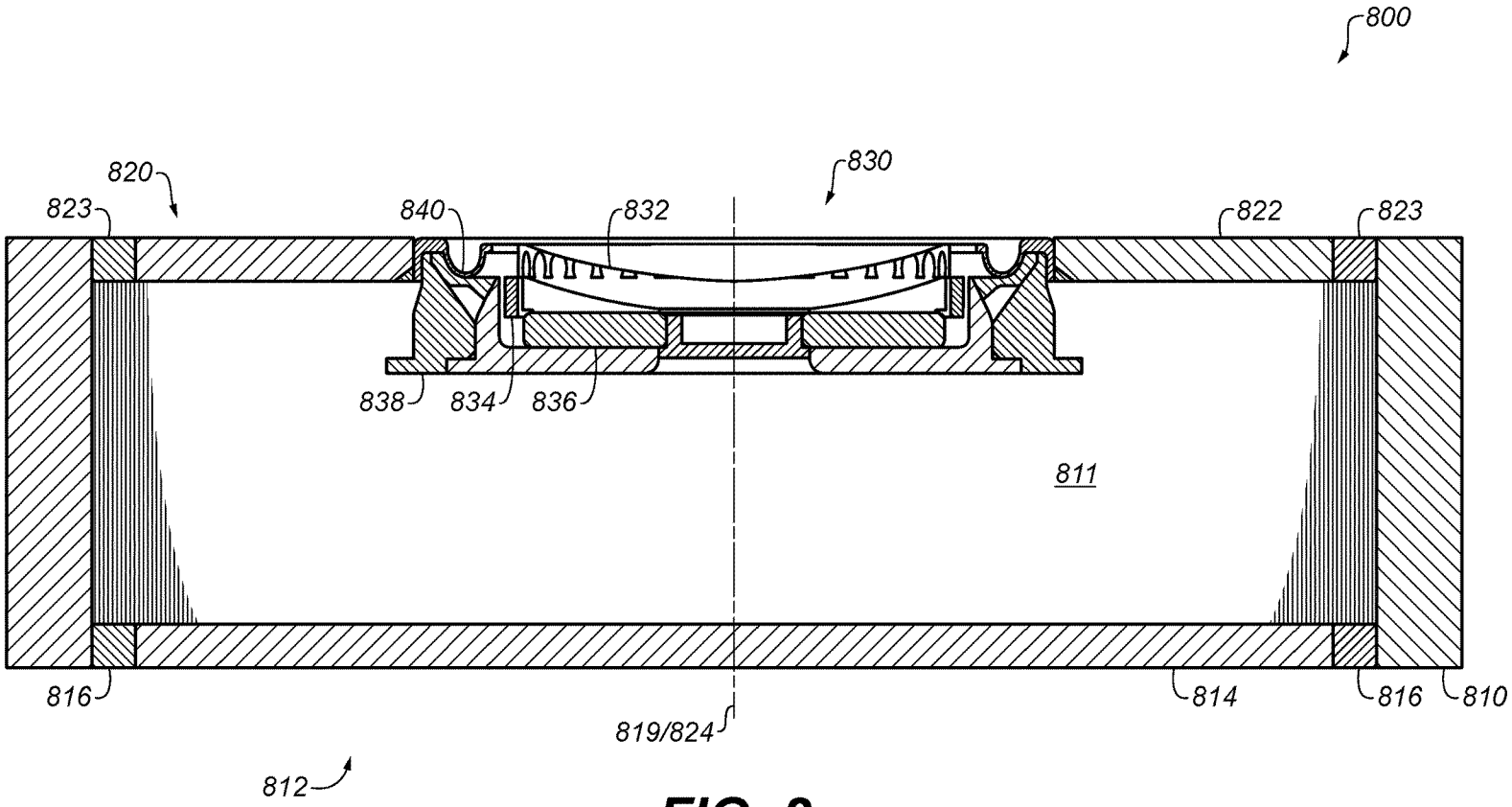
FIG. 8 is a cross-sectional side view of yet another implementation of an acoustic device with passive radiators.

For example, FIG. 8 illustrates an acoustic device 800 that includes an enclosure 810 which defines an interior cavity 811. A first passive radiator arrangement 812 closes one open side of enclosure 810. The first passive radiator arrangement 812 includes a first passive radiator diaphragm 814 which is coupled to enclosure 810 by a first suspension element 816. The first passive radiator diaphragm 814 has rear surface which is exposed to the interior cavity 811, and a front surface which is open to the outside of the enclosure 810 such that it is able to radiate sound from the enclosure 810. The first passive radiator diaphragm 814 is constructed and arranged to vibrate relative to enclosure 810 along vibration axis 819. The first passive radiator diaphragm 814 may be an essentially flat plate as shown in the drawing or may have a different construction or form as is known in the art of passive radiator diaphragms.

The acoustic device 800 also includes second passive radiator arrangement 820 which closes the opposing side of enclosure 810 from the first passive radiator arrangement 812. A second passive radiator arrangement 820 includes a second passive radiator diaphragm 822 which is coupled to enclosure 810 by a second suspension element 823, which allows the second passive radiator diaphragm 822 to move or vibrate in and out relative to enclosure 810 along vibration axis 824, which, in the illustrated implementations, is coaxial with axis 819. The second passive radiator diaphragm 822 includes rear surface which is exposed to interior cavity 811, and a front surface which is exposed to the outside of the enclosure 810 such that it is able to radiate sound from the enclosure 810.

An active electro-acoustic transducer 830 is mounted to the second passive radiator diaphragm 822 such that transducer 830 moves when the diaphragm 822 vibrates. The transducer 830 can be any known type of active acoustic transducer. In this non-limiting example the transducer 830 includes a diaphragm 832, a bobbin with voice coil 834, a magnet/iron 836, a basket 838, and a surround 840. The surround 840 does not move at the tuning frequency of the enclosure 810. Therefore, the active transducer 830 is part of the second passive radiator arrangement 820, and can be operated via audio signals (not shown) so as to radiate sound.

As transducer 830 is operated it creates pressure changes in cavity 811 which cause the first and second passive radiator diaphragms 814 and 822 to move in and out and thus radiate sound from the device 800.

The first passive radiator arrangement 812 and the second passive radiator arrangement 820 have substantially the same effective radiating area. Ideally their effective radiating areas are the same, so that there is no force imbalance.

Notably, the first passive radiator arrangement 812 has a first effective stiffness and a first effective mass, and the second passive radiator arrangement has a second effective stiffness and a second effective mass (including the mass of the active electro-acoustic transducer 830). The ratio of the first effective stiffness to the first effective mass is equal to the ratio of the second effective stiffness to the second effective mass such that the forces applied to the acoustic device 800 will be balanced over all frequencies (not just at frequencies above the resonant frequency).

A number of implementations have been described. Nevertheless, it will be understood that additional modifications may be made without departing from the scope of the inventive concepts described herein, and, accordingly, other implementations are within the scope of the following claims.

What is claimed is:

1. An acoustic device, comprising:

an enclosure defining an internal cavity;

a first passive radiator arrangement comprising a first passive radiator diaphragm arranged along a first side of the internal cavity and a second passive radiator diaphragm arranged along a second side of the internal cavity opposite the first side, wherein the first passive radiator arrangement is mounted to the enclosure such that the first passive radiator diaphragm and the second passive radiator diaphragm can vibrate relative to the enclosure;

a second passive radiator arrangement comprising a third passive radiator diaphragm, wherein the second passive radiator arrangement is mounted to the enclosure such that the third passive radiator diaphragm can vibrate relative to the enclosure; and an active electro-acoustic transducer arranged to radiate acoustic energy into the internal cavity and thereby excite vibration of the first, second, and third passive radiator diaphragms, wherein the first and second passive radiator diaphragms are coupled together such that there is substantially no relative movement therebetween as the first and passive radiator diaphragm are excited into motion relative to the enclosure via operation of the active electro-acoustic transducer.

2. The acoustic device of claim 1, wherein the first passive radiator arrangement has an effective radiating area, and the second passive radiator arrangement has substantially the same effective radiating area as the first passive radiator arrangement.

3. The acoustic device of claim 2, wherein the first passive radiator arrangement has a first effective mass and the second passive radiator arrangement has a second effective mass that is different from the first effective mass.

4. The acoustic device of claim 3, wherein the acoustic transducer is mounted to the second passive radiator diaphragm such that the mass of the active electro-acoustic transducer contributes to the first effective mass.

5. The acoustic device of claim 3, wherein the first effective mass is at least two times greater than the second effective mass.

6. The acoustic device of claim 3, wherein the first passive radiator arrangement has a first effective stiffness, and the second passive radiator arrangement has a second effective stiffness, and wherein the ratio of the first effective stiffness to the first effective mass is equal to the ratio of the second effective stiffness to the second effective mass.

7. The acoustic device of claim 1, wherein the active electro-acoustic transducer is mounted to second passive radiator diaphragm such that the active electro-acoustic transducer moves when the second passive radiator diaphragm vibrates.

8. The acoustic device of claim 7, wherein the first and second passive radiator diaphragms are coupled together via the active electro-acoustic transducer.

9. The acoustic device of claim 1, wherein the second passive radiator arrangement further comprises a fourth passive radiator diaphragm, and wherein the second passive radiator arrangement is mounted to the enclosure such that the fourth passive radiator diaphragm can vibrate relative to the enclosure.

10. The acoustic device of claim 9, wherein the third and fourth passive radiator diaphragms are configured to support a portable audio source such that vibrations of the third and fourth passive radiator diaphragms are coupled together via portable audio source.

11. The acoustic device of claim 10, wherein the mass of the portable audio source contributes to the effective mass of the second passive radiator arrangement.

12. An acoustic device, comprising:

an enclosure defining an internal cavity;

a first passive radiator arrangement comprising a first passive radiator diaphragm arranged along a first side of the internal cavity and a second passive radiator diaphragm arranged along a second side of the internal cavity opposite the first side, wherein the first passive radiator arrangement is mounted to the enclosure such that the first passive radiator diaphragm and the second passive radiator diaphragm can vibrate relative to the enclosure, and wherein the first and second passive radiator diaphragms are coupled together such that there is substantially no relative movement therebetween;

a second passive radiator arrangement comprising a third passive radiator diaphragm, wherein the second passive radiator arrangement is mounted to the enclosure such that the third passive radiator diaphragm can vibrate relative to the enclosure; and an active electro-acoustic transducer arranged to radiate acoustic energy into the internal cavity and thereby excite vibration of the first, second, and third passive radiator diaphragms, wherein the second passive radiator arrangement further comprises a fourth passive radiator diaphragm, and wherein the second passive radiator arrangement is mounted to the enclosure such that the fourth passive radiator diaphragm can vibrate relative to the enclosure, and wherein the third and fourth passive radiator diaphragms include features for locking engagement with mating features on the portable audio source.

13. The acoustic device of claim 9, wherein the third and fourth passive radiators arranged on opposite sides of the enclosure, each being arranged such that their respective motion axes are at a non-zero and non-right angle relative to a motion axis of the first and second passive radiator diaphragms.

14. An acoustic device, comprising:

an enclosure defining an internal cavity;

a first passive radiator arrangement comprising a first passive radiator diaphragm arranged along a first side of the internal cavity and a second passive radiator diaphragm arranged along a second side of the internal cavity opposite the first side, wherein the first passive radiator arrangement is mounted to the enclosure such that the first passive radiator diaphragm and the second passive radiator diaphragm can vibrate relative to the enclosure, and wherein the first and second passive radiator diaphragms are coupled together such that there is substantially no relative movement therebetween;

a second passive radiator arrangement comprising a third passive radiator diaphragm, wherein the second passive radiator arrangement is mounted to the enclosure such that the third passive radiator diaphragm can vibrate relative to the enclosure; and an active electro-acoustic transducer arranged to radiate acoustic energy into the internal cavity and thereby excite vibration of the first, second, and third passive radiator diaphragms, wherein the second passive radiator arrangement further comprises a fourth passive radiator diaphragm, and wherein the second passive radiator arrangement is mounted to the enclosure such that the fourth passive radiator diaphragm can vibrate relative to the enclosure, wherein the third and fourth passive radiators arranged on opposite sides of the enclosure, each being arranged such that their respective motion axes are at a non-zero and non-right angle relative to a motion axis of the first and second passive radiator diaphragms, and wherein the second passive radiator arrangement has an effective radiating area ($A_{eff2}$), which satisfies to the following equation:

$$A_{eff2}=(A3+A4)\cos(\theta),$$

where,

A3 is the radiating area of the third passive radiator diaphragm; and

A4 is the radiating area of the fourth passive radiator diaphragm.

15. The acoustic device of claim 1, further comprising a housing which defines the enclosure, wherein the housing is configured to support a portable audio source.

16. The acoustic device of claim 15, wherein the portable audio source comprises a mobile phone.

17. An acoustic device, comprising:

an enclosure defining an internal cavity;

a first passive radiator arrangement comprising a first passive radiator diaphragm arranged along a first side of the internal cavity and a second passive radiator diaphragm arranged along a second side of the internal cavity opposite the first side, wherein the first passive radiator arrangement is mounted to the enclosure such that the first passive radiator diaphragm and the second passive radiator diaphragm can vibrate relative to the enclosure, and wherein the first and second passive radiator diaphragms are coupled together such that there is substantially no relative movement therebetween;

a second passive radiator arrangement comprising a third passive radiator diaphragm, wherein the second passive radiator arrangement is mounted to the enclosure such that the third passive radiator diaphragm can vibrate relative to the enclosure; and an active electro-acoustic transducer arranged to radiate acoustic energy into the internal cavity and thereby excite vibration of the first, second, and third passive radiator diaphragms, wherein the first passive radiator arrangement has an effective radiating area ($A_{eff1}$), which satisfies the following equation:

$$A_{eff1}=ABS|A1-A2|$$

where,

A1 is the radiating area of the first passive radiator diaphragm; and

A2 is the radiating area of the second passive radiator including the radiating area of the active electro-acoustic transducer.

18. The acoustic device of claim 1, wherein the first and second passive radiators are rigidly coupled together via a coupling member such that as the first passive radiator diaphragm is displaced outward away from the internal cavity the second passive radiator diaphragm is drawn into the internal cavity, and vice versa.

* * * * *